US010932081B1

(12) United States Patent
Raghuvanshi et al.

(10) Patent No.: US 10,932,081 B1
(45) Date of Patent: Feb. 23, 2021

(54) BIDIRECTIONAL PROPAGATION OF SOUND

(71) Applicant: Microsoft Technology Licensing, LLC, Redmond, WA (US)

(72) Inventors: Nikunj Raghuvanshi, Redmond, WA (US); Keith William Godin, Redmond, WA (US); John Michael Snyder, Redmond, WA (US); Chakravarty Reddy Alla Chaitanya, Montreal (CA)

(73) Assignee: Microsoft Technology Licensing, LLC, Redmond, WA (US)

( * ) Notice: Subject to any disclaimer, the term of this patent is extended or adjusted under 35 U.S.C. 154(b) by 0 days.

(21) Appl. No.: 16/548,645

(22) Filed: Aug. 22, 2019

(51) Int. Cl.
*H04S 7/00* (2006.01)
*H04R 5/027* (2006.01)

(52) U.S. Cl.
CPC ..... *H04S 7/303* (2013.01); *H04R 5/027* (2013.01); *H04S 7/305* (2013.01); *H04S 7/308* (2013.01); *H04R 2201/40* (2013.01); *H04S 2400/11* (2013.01); *H04S 2420/01* (2013.01)

(58) Field of Classification Search
None
See application file for complete search history.

(56) References Cited

U.S. PATENT DOCUMENTS

| | | | |
|---|---|---|---|
| 7,146,296 | B1 | 12/2006 | Carlbom et al. |
| 7,606,375 | B2 | 10/2009 | Bailey et al. |
| 7,881,479 | B2 | 2/2011 | Asada |
| 8,670,850 | B2 | 3/2014 | Soulodre |
| 9,510,125 | B2 | 11/2016 | Raghuvanshi et al. |
| 10,206,055 | B1 | 2/2019 | Mindlin et al. |
| 2005/0058297 | A1 | 3/2005 | Jot et al. |
| 2007/0294061 | A1 | 12/2007 | Carlbom et al. |
| 2008/0069364 | A1 | 3/2008 | Itou et al. |
| 2008/0137875 | A1 | 6/2008 | Zong et al. |
| 2008/0273708 | A1 | 11/2008 | Sandgren et al. |
| 2009/0046864 | A1 | 2/2009 | Mahabub et al. |

(Continued)

FOREIGN PATENT DOCUMENTS

| | | | |
|---|---|---|---|
| CN | 1735927 | A | 2/2006 |
| CN | 101377925 | A | 3/2009 |

(Continued)

OTHER PUBLICATIONS

"Notice of Allowance Issued in U.S. Appl. No. 16/103,702", dated Nov. 14, 2019, 15 Pages.

(Continued)

*Primary Examiner* — James K Mooney
(74) *Attorney, Agent, or Firm* — Rainier Patents, P.S.

(57) ABSTRACT

The description relates to rendering directional sound. One implementation includes receiving directional impulse responses corresponding to a scene. The directional impulse responses can correspond to multiple sound source locations and a listener location in the scene. The implementation can also include encoding the directional impulse responses to obtain encoded departure direction parameters for individual sound source locations. The implementation can also include outputting the encoded departure direction parameters, the encoded departure direction parameters providing sound departure directions from the individual sound source locations for rendering of sound.

20 Claims, 19 Drawing Sheets

(56) References Cited

U.S. PATENT DOCUMENTS

| | | | | |
|---|---|---|---|---|
| 2009/0326960 | A1 | 12/2009 | Breebaat | |
| 2011/0081023 | A1 | 4/2011 | Raghuvanshi et al. | |
| 2012/0269355 | A1 | 10/2012 | Chandak et al. | |
| 2013/0120569 | A1 | 5/2013 | Mizuta | |
| 2014/0016784 | A1 | 1/2014 | Sen et al. | |
| 2014/0219458 | A1 | 8/2014 | Tanaka et al. | |
| 2015/0373475 | A1* | 12/2015 | Raghuvanshi | G10K 15/02 381/303 |
| 2016/0212563 | A1 | 7/2016 | Yuyama et al. | |
| 2018/0035233 | A1 | 2/2018 | Fielder et al. | |
| 2018/0091920 | A1* | 3/2018 | Family | H04S 7/304 |
| 2018/0109900 | A1* | 4/2018 | Lyren | H04S 7/304 |
| 2019/0313201 | A1* | 10/2019 | Torres | H04R 5/04 |
| 2019/0356999 | A1 | 11/2019 | Raghuvanshi et al. | |

FOREIGN PATENT DOCUMENTS

| | | | |
|---|---|---|---|
| CN | 101406074 | A | 4/2009 |
| CN | 101770778 | A | 7/2010 |
| CN | 103098476 | A | 5/2013 |
| EP | 1437712 | A2 | 7/2004 |

OTHER PUBLICATIONS

Takala, et al., "Sound Rendering", In Proceedings of the 19th Annual Conference on Computer Graphics and Interactive Techniques, vol. 26, Issue 2, Jul. 1, 1992, pp. 211-220.
Taylor, et al., "RESound: Interactive Sound Rendering for Dynamic Virtual Environments", In Proceedings of the 17th ACM International Conference on Multimedia, Oct. 19, 2009, 10 Pages.
Vorm, Jochem Van Der., "Transform Coding of Audio Impulse Responses", In Master's Thesis, Laboratory of Acoustical Imaging and Sound Control, Department of Imaging Science and Technology, Faculty of Applied Sciences, Delft University of Technology, Aug. 2003, 109 Pages.
Valimaki, et al., "Fifty Years of Artificial Reverberation", In Journal of IEEE Transactions on Audio, Speech, and Language Processing, vol. 20, Issue 5, Jul. 5, 2012, pp. 1421-1448.
Allen, et al., "Aerophones in Flatland: Interactive Wave Simulation of Wind Instruments", In Journal of ACM Transactions on Graphics (TOG), vol. 34, Issue 4, Aug. 1, 2015, 11 Pages.
Bilbao, et al., "Directional Sources in Wave-Based Acoustic Simulation", In Proceedings of the IEEE/ACM Transactions on Audio, Speech, and Language Processing, vol. 27 , Issue 2, Feb. 1, 2019, 14 Pages.
Cao, et al., "Interactive Sound Propagation with Bidirectional Path Tracing", In Journal ACM Transactions on Graphics (TOG), vol. 35, Issue 6, Nov. 1, 2016, 11 Pages.
Chadwick, et al., "Harmonic shells: a practical nonlinear sound model for near-rigid thin shells", In Proceedings of the ACM SIGGRAPH Asia papers Article No. 119, Dec. 16, 2009, 10 Pages.
Chaitanya, et al., "Adaptive Sampling for Sound Propagation", In Proceedings of the IEEE Transactions on Visualization and Computer Graphics, vol. 25 , Issue 5, May 1, 2019, 9 Pages.
Zhang, et al., "Ambient Sound Propagation", In Journal of ACM Transactions on Graphics (TOG), vol. 37, Issue 6, Nov. 1, 2018, 10 Pages.
James, et al., "Precomputed acoustic transfer: Output-sensitive, accurate sound generation for geometrically complex vibration sources", In Journal of ACM Transactions on Graphics (TOG), vol. 25, Issue 3, Jul. 1, 2006, 9 Pages.
Litovsky, et al., "The precedence effect", In Journal of the Acoustical Society of America 106, Jan. 1, 1999, pp. 1633-1654.
Mehra, et al., "Source and Listener Directivity for Interactive Wave-Based Sound Propagation.", In Proceedings of the IEEE Transactions on Visualization and Computer Graphics, vol. 20 , Issue 4, Apr. 1, 2014, pp. 495-503.
Pierce, Allan D., "Acoustics: An Introduction to Its Physical Principles and Applications", In Journal of the Acoustical Society of America 70, 1548, 1981, 3 Pages.
Wang, et al., "Toward Wave-based Sound Synthesis for Computer Animation", In Journal of ACM Transactions on Graphics (TOG) vol. 37, Issue 4, Jul. 1, 2018, 16 Pages.
Raghuvanshi, et al., "Efficient and Accurate Sound Propagation Using Adaptive Rectangular Decomposition", In Proceedings of the IEEE Transactions on Visualization and Computer Graphics, vol. 15 , Issue 5, Sep. 1, 2009, 10 Pages.
Raghuvanshi, et al., "Parametric Directional Coding for Precomputed Sound Propagation", In Journal of ACM Transactions on Graphics (TOG) TOG Homepage archive, vol. 37, Issue 4, Aug. 1, 2018, 14 Pages.
Raghuvanshi, et al., "Parametric Wave Field Coding for Precomputed Sound Propagation", In Journal of ACM Transactions on Graphics (TOG), vol. 33, Issue 4, Jul. 1, 2014, 11 Pages.
Savioja, Lauri, "Real-Time 3D Finite-Difference Time-Domain Simulation of Mid-Frequency Room Acoustics", In Proceedings of the 13th International Conference on Digital Audio Effects, Sep. 6, 2010, 8 Pages.
Savioja, et al., "Overview of geometrical room acoustic modeling techniques", In the Journal of Acoustical Society of America, vol. 138, Issue 2, Aug. 1, 2015, pp. 708-730.
Gumerov, et al., "Fast Multipole Methods for the Helmholtz Equation in Three Dimensions", Jan. 1, 2004, 11 Pages.
"Acoustics-Measurement of Room Acoustic Parameters—Part 1: Performance Spaces", In Proceedings of International Organization for Standardization, Jan. 2009, 2 Pages.
"Interactive 3D Audio Rendering Guidelines, Level 2.0", In Proceedings of the 3D Working Group of the Interactive Audio Special Interest Group, Sep. 20, 1999, 29 Pages.
"Final Office Action Issued in U.S. Appl. No. 12/573,157", dated Feb. 17, 2015, 18 Pages.
"Final Office Action Issued in U.S. Appl. No. 12/573,157", dated Jul. 5, 2013, 18 Pages.
"Non Final Office Action Issued in U.S. Appl. No. 12/573,157", dated Apr. 23, 2014, 19 Pages.
"Non Final Office Action Issued in U.S. Appl. No. 12/573,157", dated Aug. 20, 2015, 18 Pages.
"Non Final Office Action Issued in U.S. Appl. No. 12/573,157", dated Nov. 28, 2012, 12 Pages.
"Non-Final Office Action Issued in U.S. Appl. No. 14/311,208", dated Jan. 7, 2016, 7 Pages.
"Office Action Issued in European Patent Application No. 15738178.1", dated Apr. 25, 2017, 5 Pages.
"Final Office Action Issued in U.S. Appl. No. 16/103,702", dated Aug. 26, 2019, 32 Pages.
"Non Final Office Action Issued in U.S. Appl. No. 16/103,702", dated Mar. 15, 2019, 26 Pages.
"First Office Action and Search Report Issued in Chinese Patent Application No. 201580033425.5", dated Dec. 7, 2017, 9 Pages.
Ajdler, et al., "The Plenacoustic Function and its Sampling", In Proceedings of the IEEE Transactions on Signal Processing, vol. 54, Issue 10, Oct. 2006, pp. 3790-3804.
Astheimer, Peter, "What You See is What You Hear—Acoustics Applied in Virtual Worlds", In Proceedings of the IEEE Research Properties in Virtual Reality Symposium, Oct. 25, 1993, pp. 100-107.
Bradley, et al., "Accuracy and Reproducibility of Auditorium Acoustics Measures", In Proceedings of the British Institute of Acoustics, vol. 10, Part 2, Retrieved on: May 6, 2014, pp. 339-406.
Calamia, Paul Thomas., "Advances in Edge-Diffraction Modeling for Virtual-Acoustic Simulations", In Dissertation Presented to the Faculty of Princeton University in Candidacy for the Degree of Doctor of Philosophy, Jun. 2009, 159 Pages.
Wand, et al., "A Real-Time Sound Rendering Algorithm for Complex Scenes", In Proceedings of the Technical Report WSI-2003—5, University of Tübingen, Jul. 2003, 13 Pages.
Chandak, et al., "AD-Frustum: Adaptive Frustum Tracing for Interactive Sound Propagation", In Proceedings of the IEEE Transactions on Visualization and Computer Graphics, vol. 14, Issue 6, Nov. 2008, pp. 1707-1714.
Cheng, et al., "Heritage and Early History of the Boundary Element Method", In Proceedings of the Engineering Analysis with Boundary Elements, vol. 29, Issue 3, Feb. 12, 2005, pp. 268-302.

(56) References Cited

OTHER PUBLICATIONS

Funkhouser, et al., "A Beam Tracing Method for Interactive Architectural Acoustics", In Journal of the Acoustical Society of America, Vol. 115, Issue 2, Feb. 2004, pp. 739-756.
Funkhouser, et al., "Realtime Acoustic Modeling for Distributed Virtual Environments", In Proceedings of the 26th Annual Conference on Computer Graphics and Interactive Techniques, Jul. 1, 1999, pp. 365-374.
Funkhouser, et al., "Survey of Methods for Modeling Sound Propagation in Interactive Virtual Environment Systems", Retrieved from: https://www.cs.princeton.edu/~funk/presence03.pdf, Jan. 2003, pp. 1-53.
Gade, Anders, "Acoustics in Halls for Speech and Music", In Proceedings of the Springer Handbook of Acoustics, Jan. 2007, 8 Pages.
Gumerov, et al., "Fast Multipole Methods on Graphics Processors", In Journal of Computational Physics, vol. 227, Issue 18, Jun. 10, 2008, pp. 8290-8313.
Harris, Frederic J.., "On the Use of Windows for Harmonic Analysis with the Discrete Fourier Transform", In Proceedings of the IEEE vol. 66, Issue 1, Jan. 1978, pp. 51-84.
Hodgson, et al., "Experimental Evaluation of Radiosity for Room Sound-Field Prediction", In the Journal of the Acoustical Society of America, vol. 120, Issue 2, Aug. 2006, pp. 808-819.
Yeh, et al., "Wave-Ray Coupling for Interactive Sound Propagation in Large Complex Scenes", In Proceedings of the ACM SIGGRAPH Transactions on Graphics (TOG)—vol. 32, Issue 6, Nov. 1, 2013, 11 Pages.
Kolarik, et al., "Perceiving Auditory Distance Using Level and Direct-to-Reverberant Ratio Cues", In the Journal of the Acoustical Society of America, vol. 130, Issue 4, Oct. 2011, 4 Pages.
Krokstad, Asbjorn, "The Hundred Years Cycle in Room Acoustic Research and Design", In Proceedings of the Reflections on Sound, Norwegian University of Science and Technology, Jun. 2008, 30 Pages.
Kuttruff, Heinrich, "Room Acoustics, Fourth Edition", Published by CRC Press, Aug. 3, 2000, 369 Pages.
Lauterbach, et al., "Interactive Sound Rendering in Complex and Dynamic Scenes Using Frustum Tracing", In Proceedings of IEEE Transactions on Visualization and Computer Graphics, vol. 13, Issue 6, Nov. 2007, pp. 1672-1679.
Lentz, et al., "Virtual Reality System with Integrated Sound Field Simulation and Reproduction", In EURASIP Journal on Applied Signal Processing, vol. 2007, Issue 1, Jan. 1, 2007, 22 Pages.
Li, et al., "Spatial Sound Rendering Using Measured Room Impulse Responses", In Proceedings of the IEEE International Symposium on Signal Processing and Information Technology, Aug. 27, 2006, pp. 432-434.
Lokki, et al., "Creating Interactive Virtual Auditory Environments", In Proceedings of the IEEE on Computer Graphics and Applications, vol. 22, Issue 4, Jul. 1, 2002, pp. 49-57.
Mehra, et al., "An Efficient GPU-Based Time Domain Solver for the Acoustic Wave Equation", In Proceedings of the Applied Acoustics, vol. 73, Issue 2, Feb. 29, 2012, pp. 83-94.
Mehra, et al., "Wave-Based Sound Propagation in Large Open Scenes Using an Equivalent Source Formulation", In Journal of ACM transactions on Graphics, vol. 32, Issue 2, Apr. 1, 2013, 13 Pages.
Mehrotra, et al., "Interpolation of Combined Head and Room Impulse Response for Audio Spatialization", In Proceedings of the IEEE 13th International Workshop on Multimedia Signal Processing, Oct. 17, 2011, pp. 1-6.
Menzer, et al., "Efficient Binaural Audio Rendering Using Independent Early and Diffuse Paths", In Proceedings of the 132nd Audio Engineering Society Convention, Apr. 26, 2012, 9 Pages.
"International Search Report and Written Opinion Issued in PCT Application No. PCT/US2015/036767", dated Sep. 14, 2015, 18 Pages.
"International Search Report and Written Opinion Issued in PCT Application No. PCT/US19/029559", dated Jul. 12, 2019, 14 Pages.
Svensson, et al., "Frequency-Domain Edge Diffraction for Finite and Infinite Edges", In Proceedings of the Acta Acustica United with Acustica, vol. 95, Issue 3, May 2009, pp. 568-572.
Raghuvanshi, Nikunj, "Interactive Physically-Based Sound Simulation", In a Dissertation Submitted to the Faculty of the University of North Carolina at Chapel Hill in Partial Fulfillment of the Requirements for the Degree of Doctor of Philosophy in the Department of Computer Science, Aug. 1, 2010, 187 Pages.
Svensson, et al., "The Use of Ambisonics in Describing Room Impulse Responses", In Proceedings of the International Congress on Acoustics, Apr. 2004, pp. 2481-2483.
Raghuvanshi, et al., "Precomputed Wave Simulation for Real-Time Sound Propagation of Dynamic Sources in Complex Scenes", In Proceedings of the ACM Transactions on Graphics, vol. 29, Issue 4, Jul. 26, 2010, 11 Pages.
Rindel, et al., "The Use of Colors, Animations and Auralizations in Room Acoustics", In Proceedings of the INTER-NOISE and NOISE-CON Congress and Conference Proceedings, vol. 247, Issue 3, Sep. 15, 2013, 9 Pages.
Sabine, Hale J.., "Room Acoustics", In Proceedings of the Transactions of the IRE Professional Group on Audio, vol. 1, Issue 4, Jul. 1953, pp. 4-12.
Sakamoto, et al., "Calculation of Impulse Responses and Acoustic Parameters in a Hall by the Finite-Difference Time-Domain Method", In Proceedings of the Acoustical Science and Technology, vol. 29, Issue 4, Feb. 2008, pp. 256-265.
Savioja, et al., "Simulation of Room Acoustics with a 3-D Finite Difference Mesh", In Proceedings of the International Computer Music Conference, Sep. 1994, pp. 463-466.
Stettner, et al., "Computer Graphics Visualization for Acoustic Simulation", In Proceedings of the 16th Annual Conference on Computer Graphics, vol. 23, Issue 3, Jul. 1, 1989, pp. 195-205.
Thompson, Lonny L.., "A Review of Finite-Element Methods for Time-Harmonic Acoustics", In Journal of Acoustical Society of America, vol. 119, Issue 3, Mar. 2006, pp. 1315-1330.

* cited by examiner

SCENARIO 102A

SCENARIO 102B

SCENARIO 402

BIDIRECTIONAL PROPAGATION OF SOUND

BACKGROUND

Practical modeling and rendering of real-time directional acoustic effects (e.g., sound, audio) for video games and/or virtual reality applications can be prohibitively complex. Conventional methods constrained by reasonable computational budgets have been unable to render authentic, convincing sound with true-to-life directionality of initial sounds and/or multiply-scattered sound reflections, particularly in cases with occluders (e.g., sound obstructions). Room acoustic modeling (e.g., concert hall acoustics) does not account for free movement of either sound sources or listeners. Further, sound-to-listener line of sight is usually unobstructed in such applications. Conventional real-time path tracing methods demand enormous sampling to produce smooth results, greatly exceeding reasonable computational budgets. Other methods are limited to oversimplified scenes with few occlusions, such as an outdoor space that contains only 10-20 explicitly separated objects (e.g., building facades, boulders).

BRIEF DESCRIPTION OF THE DRAWINGS

The accompanying drawings illustrate implementations of the concepts conveyed in the present document. Features of the illustrated implementations can be more readily understood by reference to the following description taken in conjunction with the accompanying drawings. Like reference numbers in the various drawings are used wherever feasible to indicate like elements. In some cases, parentheticals are utilized after a reference number to distinguish like elements. Use of the reference number without the associated parenthetical is generic to the element. Further, the left-most numeral of each reference number conveys the FIG. and associated discussion where the reference number is first introduced.

DETAILED DESCRIPTION

Overview

Figure 1A:
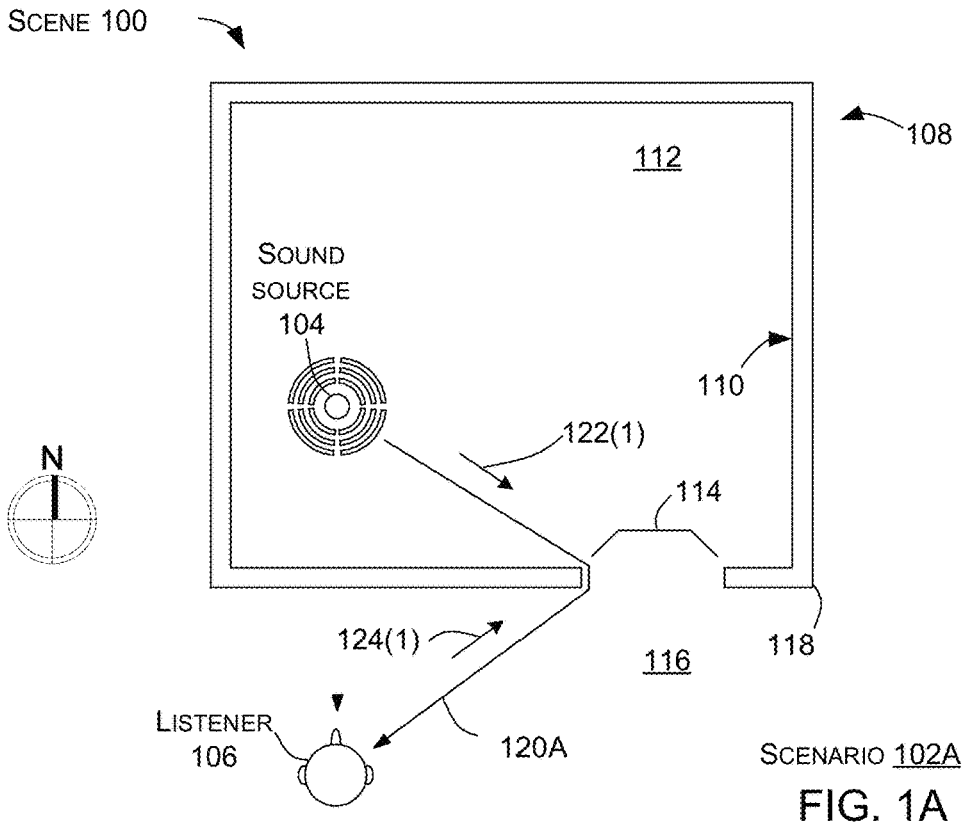
FIGS. 1A and 1B illustrate scenarios related to propagation of initial sound, consistent with some implementations of the present concepts.

As noted above, modeling and rendering of real-time directional acoustic effects can be very computationally intensive. As a consequence, it can be difficult to render realistic directional acoustic effects without sophisticated and expensive hardware. Some methods have attempted to account for moving sound sources and/or listeners but are unable to also account for scene acoustics while working within a reasonable computational budget. Still other methods neglect sound directionality entirely.

The disclosed implementations can generate convincing sound for video games, animations, and/or virtual reality scenarios even in constrained resource scenarios. For instance, the disclosed implementations can model source directivity by rendering sound that accounts for the orientation of a directional source. In addition, the disclosed implementations can model listener directivity by rendering sound that accounts for the orientation of a listener. Taken together, these techniques allow for rendering of sound that accounts for the relationship between source and listener orientation for both initial sounds and sound reflections, as described more below.

Source and listener directivity can provide important sound cues for a listener. With respect to source directivity, speech, audio speakers, and many musical instruments are directional sources, e.g., these sound sources can emit directional sound that tends to be concentrated in a particular direction. As a consequence, the way that a directional sound source is perceived depends on the orientation of the sound source. For instance, a listener can detect when a speaker turns toward the listener and this tends to draw the listener's attention. As another example, human beings naturally face toward an open door when communicating with a listener in another room, which causes the listener to perceive a louder sound than were the speaker to face in another direction.

Listener directivity also conveys important information to listeners. Listeners can perceive the direction at which incoming sound arrives, and this is also an important audio cue that varies with the orientation of the listener. For example, standing outside a meeting hall, a listener is able to locate an open door by listening for the chatter of a crowd in the meeting hall streaming through the door. This is because the listener can perceive the arrival direction of the sound as arriving from the door, allowing the listener to locate the crowd even when sight of the crowd is obscured to the listener. If the listener's orientation changes, the user perceives that the arrival direction of the sound changes accordingly.

In addition to source and listener directivity, the time at which sound waves are received at the listener conveys important information. For instance, for a given wave pulse introduced by a sound source into a scene, the pressure response or "impulse response" at the listener arrives as a series of peaks, each of which represents a different path that the sound takes from the source to the listener. Listeners tend to perceive the direction of the first-arriving peak in the impulse response as the arrival direction of the sound, even when nearly-simultaneous peaks arrive shortly thereafter from different directions. This is known as the "precedence effect." This initial sound takes the shortest path through the air from a sound source to a listener in a given scene. After the initial sound, subsequent reflections are received that generally take longer paths through the scene and become attenuated over time.

Thus, humans tend to perceive sound as an initial sound followed by reflections and then subsequent reverberations. As a result of the precedence effect, initial sounds tend to enable listeners to perceive where the sound is coming from, whereas reflections and/or reverberations tend to provide listeners with information about the scene because they convey how the impulse response travels along many different paths within the scene.

Considering reflections specifically, they can be perceived differently by the user depending on properties of the scene. For instance, when a sound source and listener are close (e.g., within footsteps), a delay between arrival of the initial sound and corresponding first reflections can become audible. The delay between the initial sound and the reflections can strengthen the perception of distance to walls.

Moreover, reflections can be perceived differently based on the orientation of both of the source and listener. For instance, the orientation of a directional sound source can affect how reflections are perceived via a listener. When a directional sound source is oriented directly toward a listener, the initial sound tends to be relatively loud and the reflections and/or reverberations tend to be somewhat quiet. Conversely, if the directional sound source is oriented away from the listener, the power balance between the initial sound and the reflections and/or reverberations can change, so that the initial sound is somewhat quieter relative to the reflections.

The disclosed implementations offer computationally efficient mechanisms for modeling and rendering of directional acoustic effects. Generally, the disclosed implementations can model a given scene using perceptual parameters that represent how sound is perceived at different source and listener locations within the scene. Once perceptual parameters have been obtained for a given scene as described herein, the perceptual parameters can be used for rendering of arbitrary source and listener positions as well as arbitrary source and listener orientations in the scene.

Initial Sound Propagation

Figure 1B:
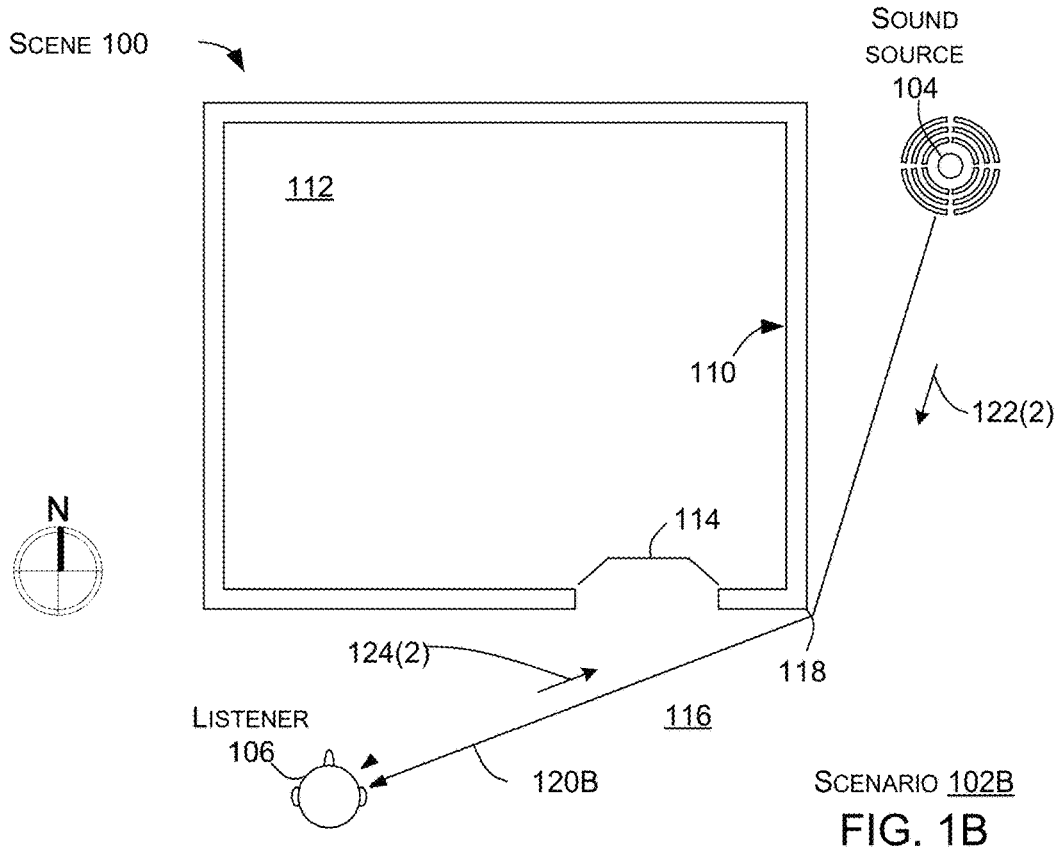

FIGS. 1A and 1B are provided to introduce the reader to concepts relating to the directionality of initial sound using a relatively simple scene 100. FIG. 1A illustrates a scenario 102A and FIG. 1B illustrates a scenario 102B, each of which conveys certain concepts relating to how initial sound emitted by a sound source 104 is perceived by a listener 106 based on acoustic properties of scene 100.

For instance, scene 100 can have acoustic properties based on geometry 108, which can include structures such as walls 110 that form a room 112 with a portal 114 (e.g., doorway), an outside area 116, and at least one exterior corner 118. As used herein, the term "geometry" can refer to an arrangement of structures (e.g., physical objects) and/or open spaces in a scene. Generally, the term "scene" is used herein to refer to any environment in which real or virtual sound can travel. In some implementations, structures such as walls can cause occlusion, reflection, diffraction, and/or scattering of sound, etc. Some additional examples of structures that can affect sound are furniture, floors, ceilings, vegetation, rocks, hills, ground, tunnels, fences, crowds, buildings, animals, stairs, etc. Additionally, shapes (e.g., edges, uneven surfaces), materials, and/or textures of structures can affect sound. Note that structures do not have to be solid objects. For instance, structures can include water, other liquids, and/or types of air quality that might affect sound and/or sound travel.

Generally, the sound source 104 can generate a sound pulses that create corresponding impulse responses. The impulse responses depend on properties of the scene 100 as well as the locations of the sound source and listener. As discussed more below, the first-arriving peak in the impulse response is typically perceived by the listener 106 as an initial sound, and subsequent peaks in the impulse response tend to be perceived as reflections. FIGS. 1A and 1B convey how this initial peak tends to be perceived by the listener, and subsequent examples describe how the reflections are perceived by the listener. Note that this document adopts the convention that the top of the page faces north for the purposes of discussing directions.

A given sound pulse can result in many different sound wavefronts that propagate in all directions from the source. For simplicity, FIG. 1A shows a single such wavefront, initial sound wavefront 120A, that is perceived by listener 106 as the first-arriving sound. Because of the acoustic properties of scene 100 and the respective positions of the sound source and the listener, the listener perceives initial sound wavefront 120A as arriving from the northeast. For instance, in a virtual reality world based on scenario 102A, a person (e.g., listener) looking at a wall with a doorway to their right would likely expect to hear a sound coming from their right side, as walls 110 attenuate the sound energy that travels directly along the line of sight between the sound source 104 and the listener 106. In general, the concepts disclosed herein can be used for rendering initial sound with realistic directionality, such as coming from the doorway in this instance.

In some cases, the sound source 104 can be mobile. For example, scenario 102B depicts the sound source 104 in a different location than scenario 102A. In scenario 102B, both the sound source 104 and listener are in outside area 116, but the sound source is around the exterior corner 118 from the listener 106. Once again, the walls 110 obstruct a line of sight between the listener and the sound source. Thus, in this example, the listener perceives initial sound wavefront 120B as the first-arriving sound coming from the northeast.

The directionality of sound wavefronts can be represented using departure direction indicators that convey the direction from which sound energy departs the source 104, and arrival direction indicators that indicate the direction from which sound energy arrives at the listener 106. For instance, referring back to FIG. 1A, note that initial sound wavefront 120A leaves the sound source 104 in a generally southeast direction as conveyed by departure direction indicator 122 (1), and arrives at the listener 106 from a generally northeast direction as conveyed by arrival direction indicator 124(1). Likewise, considering FIG. 1B, initial sound wavefront 120B leaves the sound source in a south-southwest direction as conveyed by departure direction indicator 122(2) and arrives at the listener from an east-northeast direction as conveyed by arrival direction indicator 124(2). By convention, this document uses departure direction indicators that point in the direction of travel of sound from the source toward the listener, and arrival direction indicators that point in the direction that sound is received from the listener toward the source.

Initial Sound Encoding

Consider a pair of source and listener locations in a given scene, with a sound source located at the source location and a listener located at the listener location. The direction of initial sound perceived by the listener is generally a function of acoustic properties of the scene as well as the location of the source and listener. Thus, the first sound wavefront perceived by the listener will generally leave the source in a particular direction and arrive at the listener in a particular direction. This is the case even for directional sound sources, irrespective of the orientation of the source and the listener. As a consequence, it is possible to encode departure and arrival directions parameters for initial sounds in a scene using an isotropic sound pulse without sampling different source and listener orientations, as discussed more below.

Figure 2:
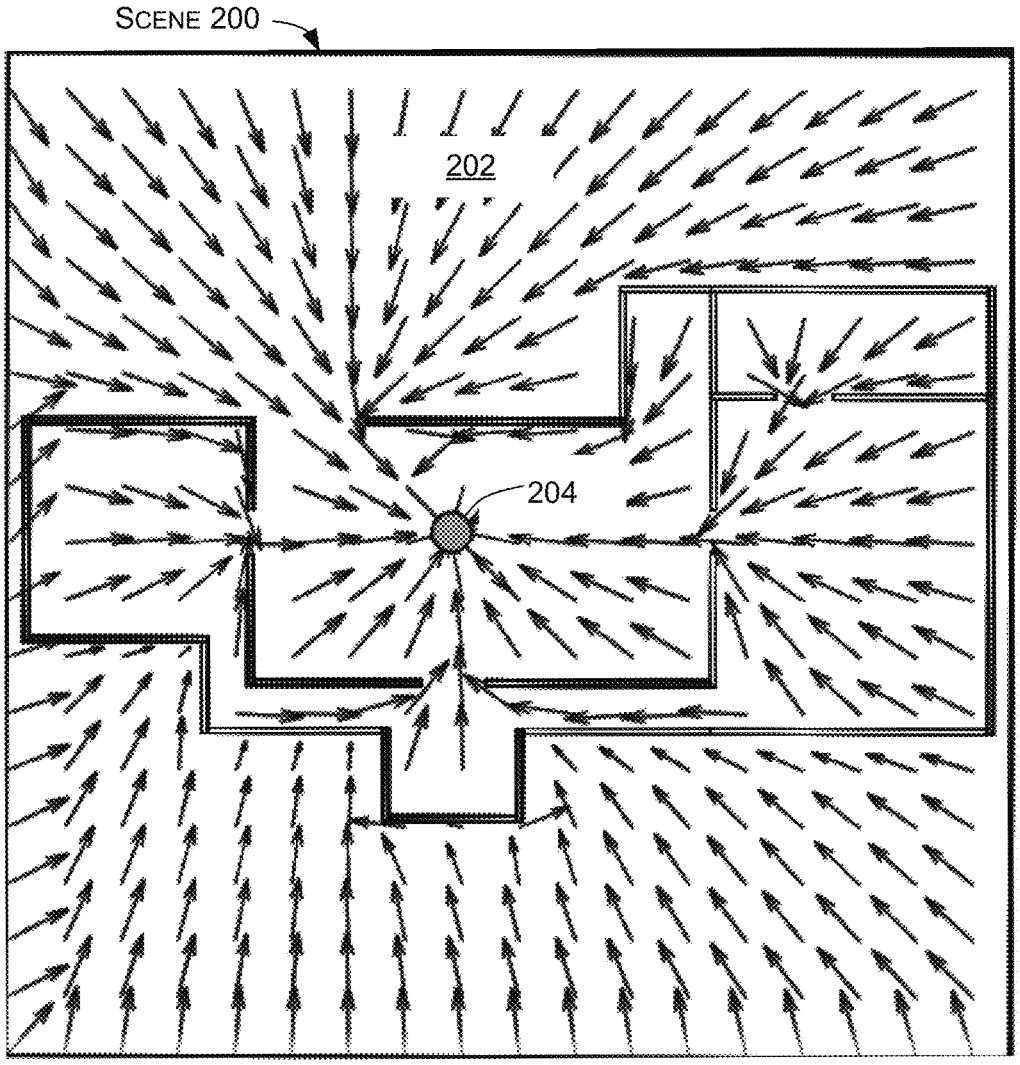
FIG. 2 illustrates an example of a field of departure direction indicators, consistent with some implementations of the present concepts.
Figure 2:
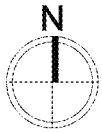

One way to represent the departure direction of initial sound in a given scene is to fix a listener location and encode departure directions from different potential source locations for sounds that travel from the potential source locations to the fixed listener location. FIG. 2 depicts an example scene 200 and a corresponding departure direction field 202 with respect to a listener location 204. The encoded departure direction field includes many departure direction indicators, each of which is located at a potential source location from which a source can emit sounds. Each departure direction indicator conveys that initial sound travels from that source location to the listener location 204 in the direction indicated by that departure direction parameter. In other words, for any source placed at a given departure direction indicator, initial sounds perceived at listener location 204 will leave that source location in the direction indicated by that departure direction indicator.

Figure 3:
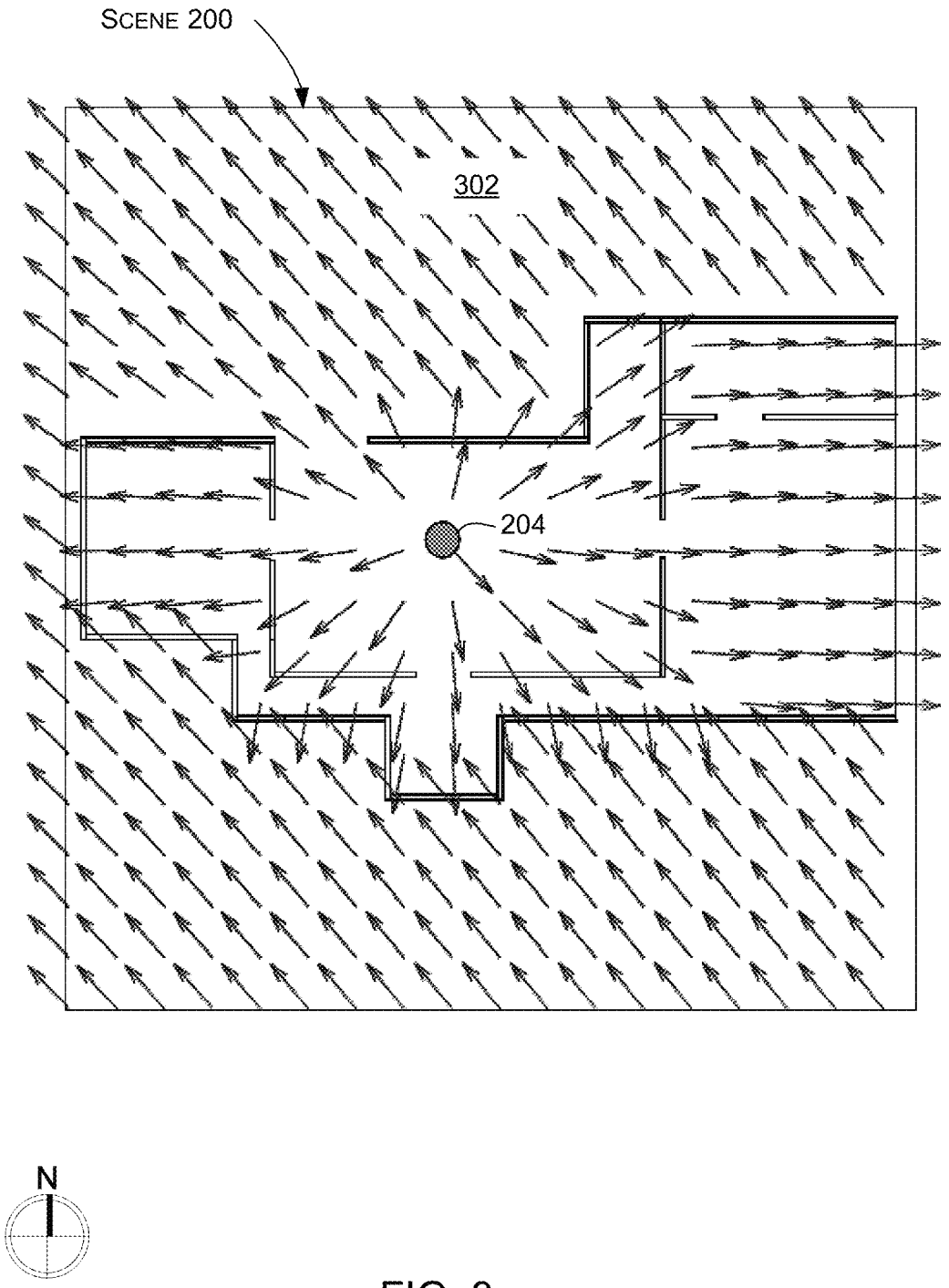
FIG. 3 illustrates an example of a field of arrival direction indicators, consistent with some implementations of the present concepts.

One way to represent the arrival directions of initial sound in a given scene is to use a similar approach as discussed above with respect to departure directions. FIG. 3 depicts example scene 200 with an arrival direction field 302 with respect to listener location 204. Similar to the departure direction field discussed above, the arrival direction field includes many arrival direction indicators, each of which is located at a source location from which a source can emit sounds. Each individual arrival direction indicator conveys that initial sound emitted from the corresponding source location is received at the listener location 204 in the direction indicated by that arrival direction indicator. As noted previously with respect to FIGS. 1A and 1B, the arrival direction indicators point away from the listener in the direction of incoming sound by convention.

Taken together, departure direction field 202 and arrival direction field 302 provide a bidirectional representation of initial sound travel in scene 200 for a specific listener location. Note that each of these fields can represent a horizontal "slice" within scene 200. Thus, different arrival and departure direction fields can be generated for different vertical heights within scene 200 to create a volumetric representation of initial sound directionality for the scene with respect to the listener location.

As discussed more below, different departure and arrival direction fields and/or volumetric representations can be generated for different potential listener locations in scene 200 to provide a relatively compact bidirectional representation of initial sound directionality in scene 200. In particular, as discussed more below, departure direction fields and arrival direction fields allow for rendering of initial sound with arbitrary source and listener location and orientation. For instance, each departure direction indicator can represent an encoded departure direction parameter for a specific source/location pair, and each arrival direction indicator can represent an encoded arrival direction parameter for that specific source/location pair. Generally, the relative density of each encoded field can be a configurable parameter that varies based on various criteria, where denser fields can be used to obtain more accurate directionality and sparser fields can be employed to obtain computational efficiency and/or more compact representations.

Reflection Encoding

As noted previously, reflections tend to convey information about a scene to a listener. Like initial sound, the paths taken by reflections from a given source location to a given listener location within a scene generally do not vary based on the orientation of the source or listener. As a consequence, it is possible to encode source and listener directionality for reflections for source/location pairs in a given scene without sampling different source and listener locations. However, in practice, there are often many, many reflections and it may be impractical to encode source and listener directionality for each reflection path. Thus, the disclosed implementations offer mechanisms for compactly representing directional reflection characteristics in an aggregate manner, as discussed more below.

Figure 4:
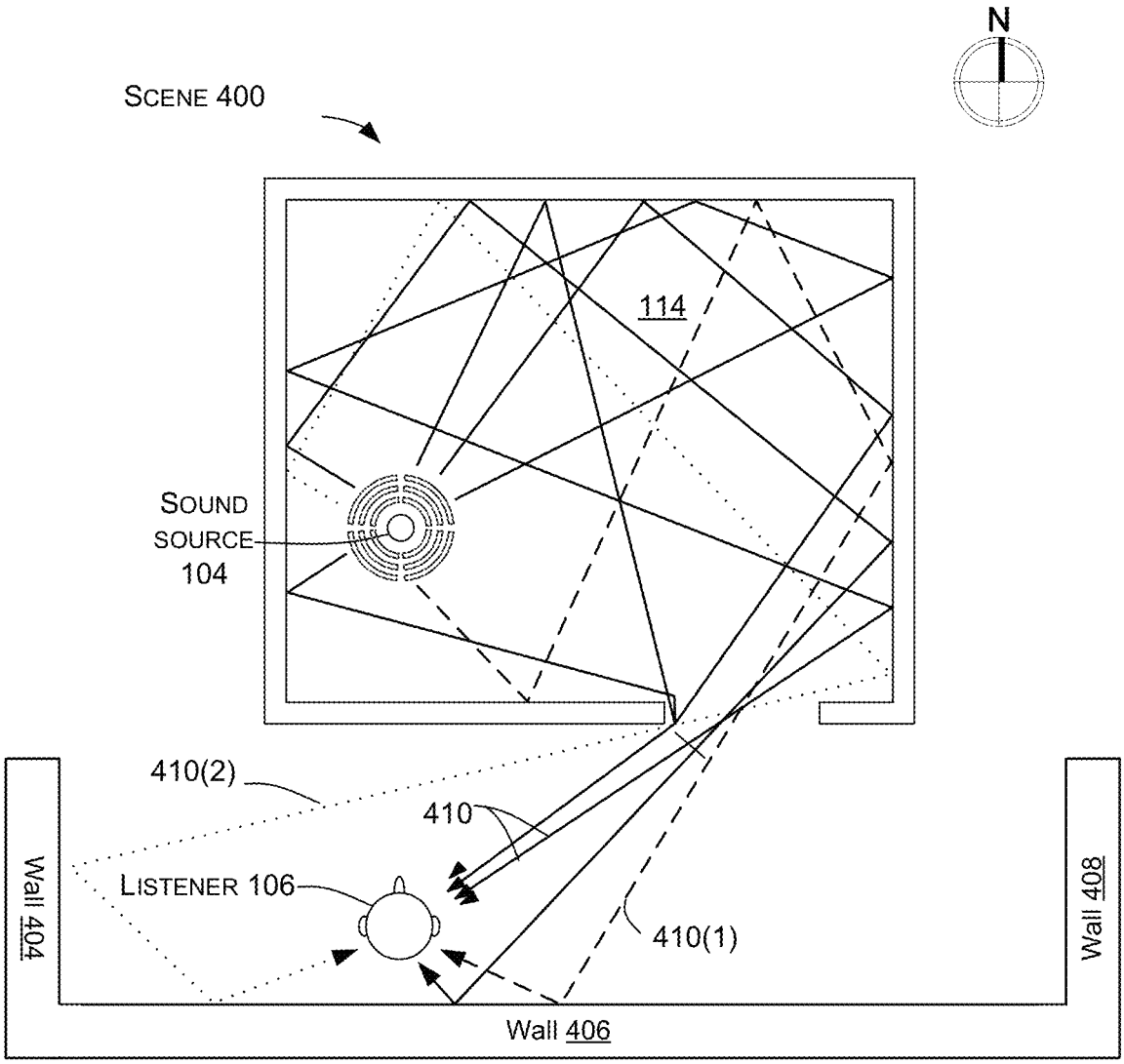
FIG. 4 illustrates a scenario related to propagation of sound reflections, consistent with some implementations of the present concepts.

FIG. 4 will now be used to introduce concepts relating to reflections of sound. FIG. 4 shows another scene 400 and introduces a scenario 402. Scene 400 is similar to scene 100 with the addition of walls 404, 406, and 408. In this case, FIG. 4 includes reflection wavefronts 410 and omits a representation of any initial sound wavefront for clarity. Only a few reflection wavefronts 410 are designated to avoid clutter on the drawing page. In practice, many more reflection wavefronts may be present in the impulse response for a given sound.

Note that the reflection wavefronts are emitted from sound source 104 in many different directions and arrive at the listener 106 in many different directions. Each reflection wavefront carries a particular amount of sound energy (e.g., loudness) when leaving the source 104 and arriving at the listener 106. Consider reflection wavefront 410(1), designated by a dashed line in FIG. 4. Sound energy carried by reflection wavefront 410(1) leaves sound source 104 to the southeast of the sound source and arrives at listener 106 from the southeast. One way to represent the sound energy leaving source 104 for reflection wavefront 410(1) is to decompose the sound energy into a first directional loudness component for sound energy emitted to the south, and a second directional loudness component for sound energy emitted to the east. Likewise, the sound energy arriving at listener 106 for reflection wavefront 410(1) can be composed into a first directional loudness component for sound energy received from the south, and a second directional loudness component for sound energy received from the east.

Now, consider reflection wavefront 410(2), designated by a dotted line in FIG. 4. Sound energy carried by reflection wavefront 410(2) leaves sound source 104 to the northwest of the sound source and arrives at listener 106 from the southwest. One way to represent the sound energy leaving source 104 for reflection wavefront 410(2) is to decompose the sound energy into a first directional loudness component for sound energy emitted to the north, and a second directional loudness component for sound energy emitted to the west. Likewise, the sound energy arriving at listener 106 for reflection wavefront 410(2) can be decomposed into a first directional loudness component for sound energy arriving from the south, and a second directional loudness component for sound energy arriving from the west.

The disclosed implementations can decompose reflection wavefronts into directional loudness components as discussed above for different potential source and listener locations. Subsequently, the directional loudness components can be used to encode directional reflection characteristics associated with pairs of source and listener locations. In some cases, the directional reflection characteristics can be encoded by aggregating the directional loudness components into an aggregate representation of bidirectional reflection loudness, as discussed more below.

Figure 5:
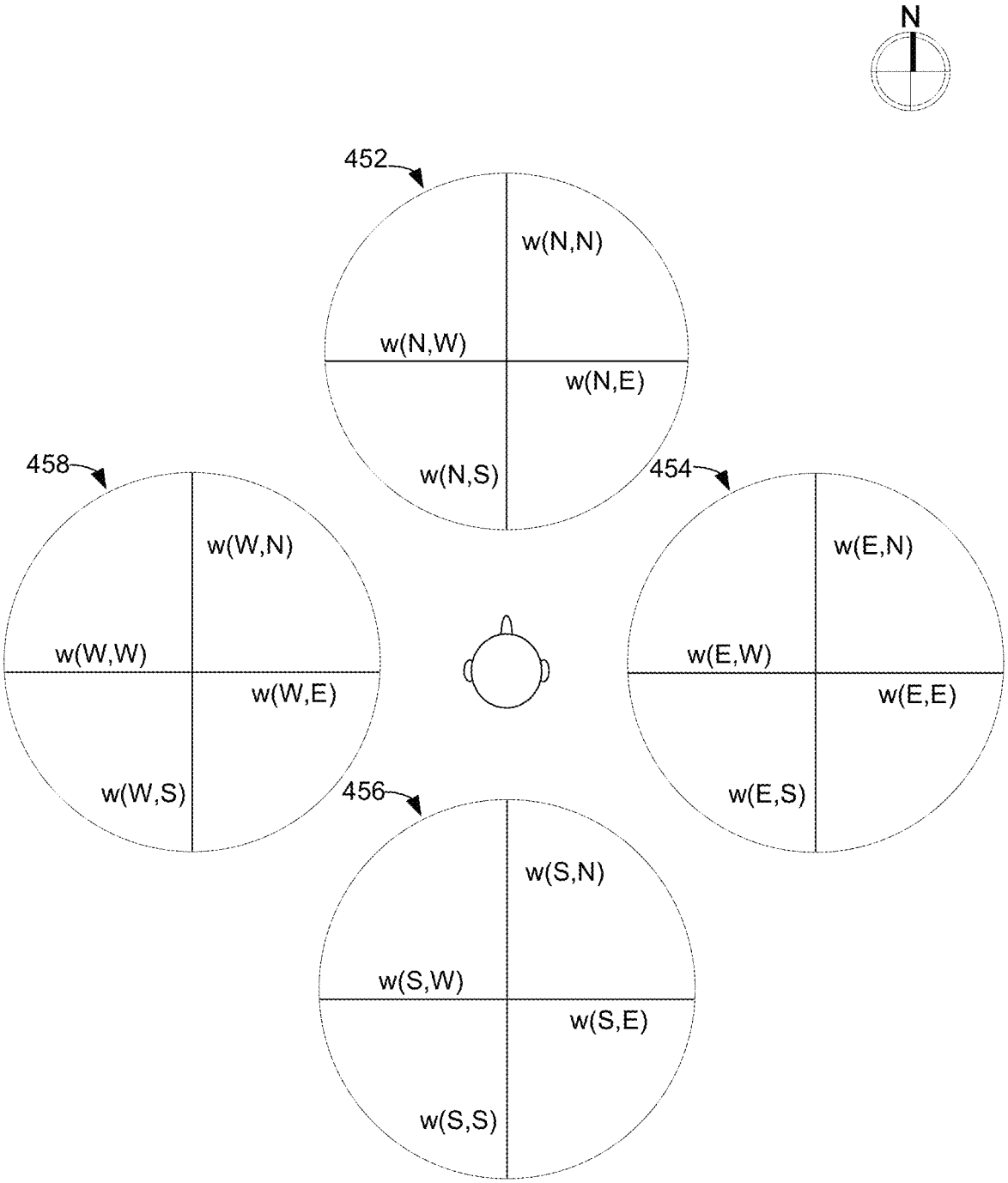
FIG. 5 illustrates an example of an aggregate representation of directional reflection energy, consistent with some implementations of the present concepts.

FIG. 5 illustrates one mechanism for compact encoding of reflection directionality. FIG. 5 shows reflection loudness parameters in four sets—a first reflection parameter set 452 representing loudness of reflections arriving at a listener from the north, a second reflection parameter set 454 representing loudness of reflections arriving at a listener from the east, a third reflection parameter set 456 representing loudness of reflections arriving at a listener from the south, and a fourth reflection parameter set 458 representing loudness of reflections arriving at a listener from the west. Each reflection parameter set includes four reflection loudness parameters, each of which can be a corresponding weight that represents relative loudness of reflections arriving at the listener for sounds emitted by the source in one of these four canonical directions. For instance, each reflection loudness parameter in first reflection parameter set 452 represents an aggregate reflection energy arriving at by the listener from the north for a corresponding departure direction at the source. Thus, reflection loudness parameter w(N, N) represents the aggregate reflection energy arriving the listener from the north for sounds departing north from the source, reflection loudness parameter w(N, E) represents the aggregate reflection energy received by the listener from the north for sounds departing east from the source, and so on.

Likewise, each reflection loudness parameter in second reflection parameter set 454 represents an aggregate reflection energy arriving at the listener from the east and departing from the source in one of the four directions. Weight w(E, S) represents the aggregate reflection energy arriving at the listener from the east for sounds departing south from the source, weight W(E, W) represents the aggregate reflection energy arriving at the listener from the east for sounds departing west of the source, and so on. Reflection parameter sets 456 and 458 represent aggregate reflection energy arriving at the listener from the south and west, respectively, with similar individual parameters in each set for each departure direction from the source.

Generally, reflection parameter sets 452, 454, 456, and 458 can be obtained by decomposing each individual reflection wavefront into constituent directional loudness components as discussed above and aggregating those values for each reflection wavefront. For instance, as previously noted, reflection wavefront 410(1) arrives at the listener 106 from the south and the east, and thus can be decomposed into a directional loudness component for energy received from the south and a directional loudness component for energy received to the east. Furthermore, reflection wavefront 410(1) includes energy departing the source from the south and from the east. Thus, the directional loudness component for energy arriving at the listener from the south can be further decomposed into a directional loudness component for sound departing south from the south, shown in FIG. 5 as w(S, S) in reflection parameter set 456, and another directional loudness component for sound departing east from the source, shown in FIG. 5 as w(S, E) in reflection parameter set 456. Similarly, the directional loudness component for energy arriving at the listener from the east can be further decomposed into a directional loudness component for sound departing south of the source, shown in FIG. 5 as w(E, S) in reflection parameter set 454, and another directional loudness component for sound departing east of the source, shown in FIG. 5 as w(E, E) in reflection parameter set 454.

Likewise, considering reflection wavefront 410(2), this reflection wavefront arrives at the listener 106 from the south and the west and includes departs the source to the north and the west. Energy from reflection wavefront 410(2) be decomposed into directional loudness components for both the source and listener and aggregated as discussed above for reflection wavefront 410(2). Specifically, four directional loudness components can be obtained and aggregated into w(S, N) for energy arriving the listener from the south and departing north from the source, weight w(S, W) for energy arriving the listener from the south and departing west from the source, w(W, N) for energy arriving at the listener from the west and departing north from the source, and w(W, W) for energy arriving at the listener from the west and departing west from the source.

The above process can be repeated for each reflection wavefront to obtain a corresponding aggregate directional reflection loudness for each combination of canonical directions with respect to both the source and the listener. As discussed more below, such an aggregate representation of directional reflection energy can be used at runtime to effectively render reflections for directional sources that accounts for both source and listener location and orientation, including scenarios with directional sound sources. Taken together, realistic directionality of both initial sound arrivals and sound reflections can improve sensory immersion in virtual environments.

Note that FIG. 5 illustrates four compass directions and a thus a total of 16 weights, for each possible combination of departure and arrival directions. Examples introduced below can also account for up and down directions as well, in addition to the four compass directions previously discussed, yielding 6 canonical directions and potentially 36 reflection loudness parameters, one for each possible combination of departure and arrival directions.

In addition, note that aggregate reflection energy representations can be generated as fields for a given scene, as described above for arrival and departure direction. Likewise, a volumetric representation of a scene can be generated by "stacking" fields of reflection energy representations vertically above one another, to account for how reflection energy may vary depending on the vertical height of a source and/or listener.

Time Representation

As discussed above, FIGS. 2 and 3 illustrate mechanisms for encoding departure and arrival direction parameters for a specific source/location pair in scene. Likewise, FIG. 5 illustrates a mechanism for representing aggregate reflection energy parameters for various combinations of arrival and departure directions for a specific source/location pair in a scene. The following provides some additional discussion of these parameters as well as some additional parameters that can be used to encode bidirectional propogation characteristics of a scene.

Figure 6A:
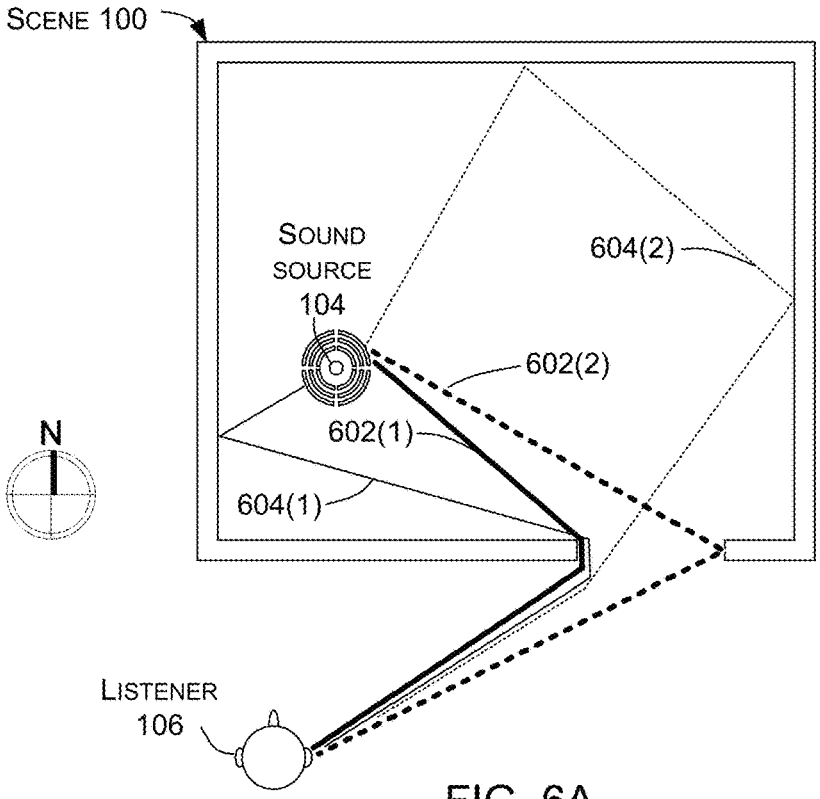
FIG. 6A illustrates a scenario related to propagation of initial sound and sound reflections, consistent with some implementations of the present concepts.

FIG. 6A shows scene 100 with two initial sound wavefronts 602(1) and 602(2) and two reflection wavefronts 604(1) and 604(2). Initial sound wavefronts 602(1) and 602(2) are shown in relatively heavy lines to convey that these sound wavefronts typically carry more sound energy to the listener 106 than reflection wavefronts 604(1) and 604(2). Initial sound wavefront 602(1) is shown as a solid heavy line and initial sound wavefront 602(2) is shown as a dotted heavy line. Reflection wavefront 604(1) is shown as a solid lightweight line and reflection wavefront 604(2) is shown as a dotted lightweight line.

Figure 6B:
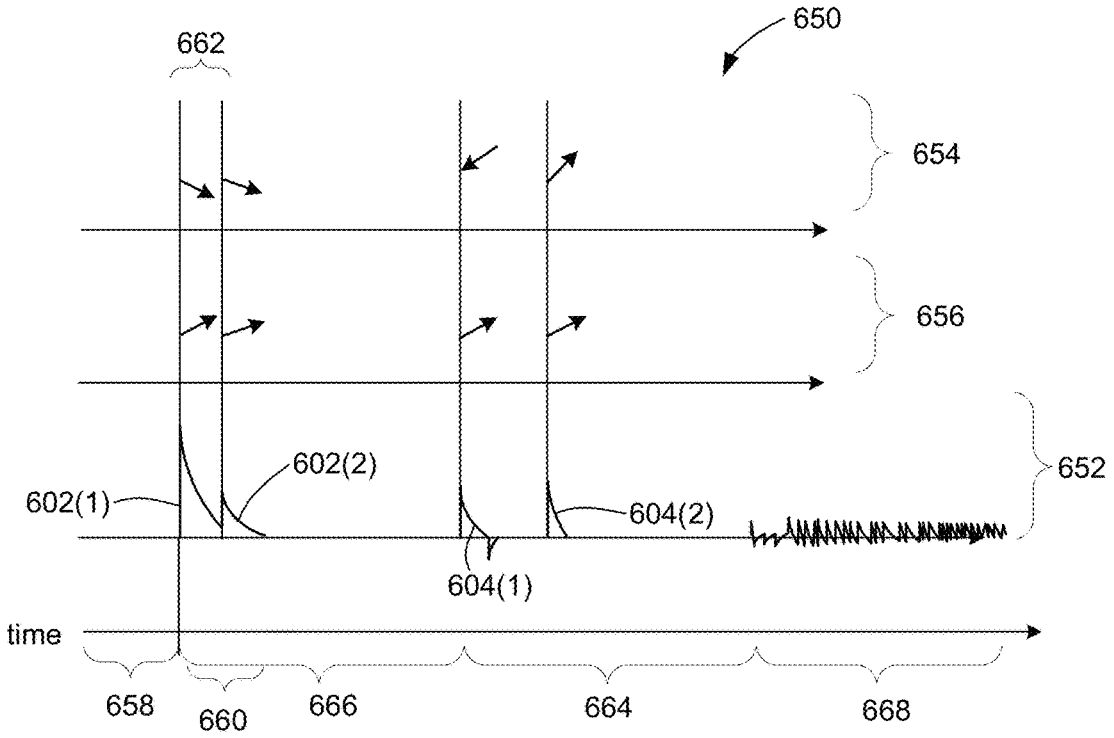
FIG. 6B illustrates an example time domain representation of initial sound and sound reflections, consistent with some implementations of the present concepts.

FIG. 6B shows a time-domain representation 650 of the sound wavefronts shown in FIG. 6A, as well as how individual encoded parameters can be represented in the time domain. Note that time-domain representation 650 is somewhat simplified for clarity, and actual time-domain representations of sound are typically more complex than illustrated in FIG. 6B.

Time-domain representation 650 includes time-domain representations of initial sound wavefronts 602(1) and 602(2), as well as time-domain representations of reflection wavefronts 604(1) and 604(2). In the time domain, each wavefront appears as a "spike" in impulse response area 652. Thus, in physical space, each spike corresponds to a particular path through the scene from the source to the listener. The corresponding departure direction of each wavefront is shown in area 654, and the corresponding arrival direction of each wavefront is shown in area 656.

Time-domain representation 650 also includes an initial or onset delay period 658 which represents the time period after sound is emitted from sound source 104 before the first-arriving wavefront to listener 106, which in this example is initial sound wavefront 602(1). The initial delay period parameter can be determined for each source/location pair in the scene, and encodes the amount of time before a listener at a specific listener location hears initial sound from a specific source location.

Time domain representation 650 also includes an initial loudness period 660 and an initial directionality period 662. The initial loudness period 660 can correspond to a period of time starting at the arrival of the first wavefront to the listener and continuing for a predetermined period during which an initial loudness parameter is determined. The initial directionality period 662 can correspond to a period of time starting at the arrival of the first wavefront to the listener and continuing for a predetermined period during which initial source and listener directions are determined.

Note that the initial directionality period 662 is illustrated as being somewhat shorter than the initial loudness period 660, for the following reasons. Generally, the first-arriving wavefront to a listener has a strong effect on the listener's sense of direction. Subsequent wavefronts arriving shortly thereafter tend to contribute to the listener's perception of initial loudness, but generally contribute less to the listener's perception of initial direction. Thus, in some implementations, the initial loudness period is longer than the initial directionality period.

Referring back to FIG. 6A, initial sound wavefront 602(1) has the shortest path to the listener 106 and thus arrives at the listener first, after the onset delay period 658. The corresponding impulse response for initial wavefront occurs within the initial directionality period 662. Consider next initial sound wavefront 602(2). This wavefront has a somewhat longer path to the listener and arrives within the initial loudness period 660, but outside of the initial directionality period 662. Thus, in this example, initial sound wavefront 602(2) contributes to an initial loudness parameter but does not contribute to the initial departure and arrival direction parameters, whereas initial sound wavefront 602(2) contributes to the initial loudness parameter, the initial departure direction parameter, and the initial arrival direction parameter. Each of these parameters can be determined for each source/location pair in the scene. The initial loudness parameter encodes the relative loudness of initial sound that a listener at a specific listener location hears from a given source location. As discussed above, the initial departure and arrival direction parameters encode the directions in which initial sound leaves the source location and arrives at the listener location, respectively.

Time-domain representation 650 also includes a reflection aggregation period 664, which represents a period of time during which reflection loudness is aggregated. Referring back to FIG. 6A, reflection wavefronts 604(1) and 604(2) arrive some time after after initial sound wavefronts 602(1) and 602(2) arrive at the listener. These reflection wavefronts can contribute to an aggregate reflection energy representation such as described above with respect to FIG. 5. One such aggregate reflection energy representation can be determined for each source/location pair in the scene (e.g., a 4×4 or 6×6 matrix), and each entry (e.g., weight) in the aggregate reflection energy representation can constitute a different loudness parameter. Thus, each parameter in the aggregate reflection energy representation encodes reflection loudness for a specific combination of the following: source location, departure direction, listener location, and arrival direction. Reflection delay period 666 represents the amount of time after the first sound wavefront arrives until the listener hears the first reflection. Reflection delay period is another parameter can be determined for each source/location pair in the scene.

Time-domain representation 650 also includes a reverberation decay period 668, which represents an amount of time during which sound wavefronts continue to reverberate and decay in scene 100. In some implementations, additional wavefronts that arrive after the reflection loudness period 664 are used to determine a reverberation decay time. Reveberation decay period is another parameter that can be determined for each source/location pair in the scene.

Generally, the durations of the initial loudness period 660, the initial directionality period 662, and/or reflection aggregation period 664 can be configurable. For instance, the initial directionality period can last for 1 millisecond after the onset delay period 658. The initial loudness period can last for 10 milliseconds after the onset delay period. The reflection loudness period can last for 80 milliseconds after the first-detected reflection wavefront.

Rendering Examples

Figure 7A:
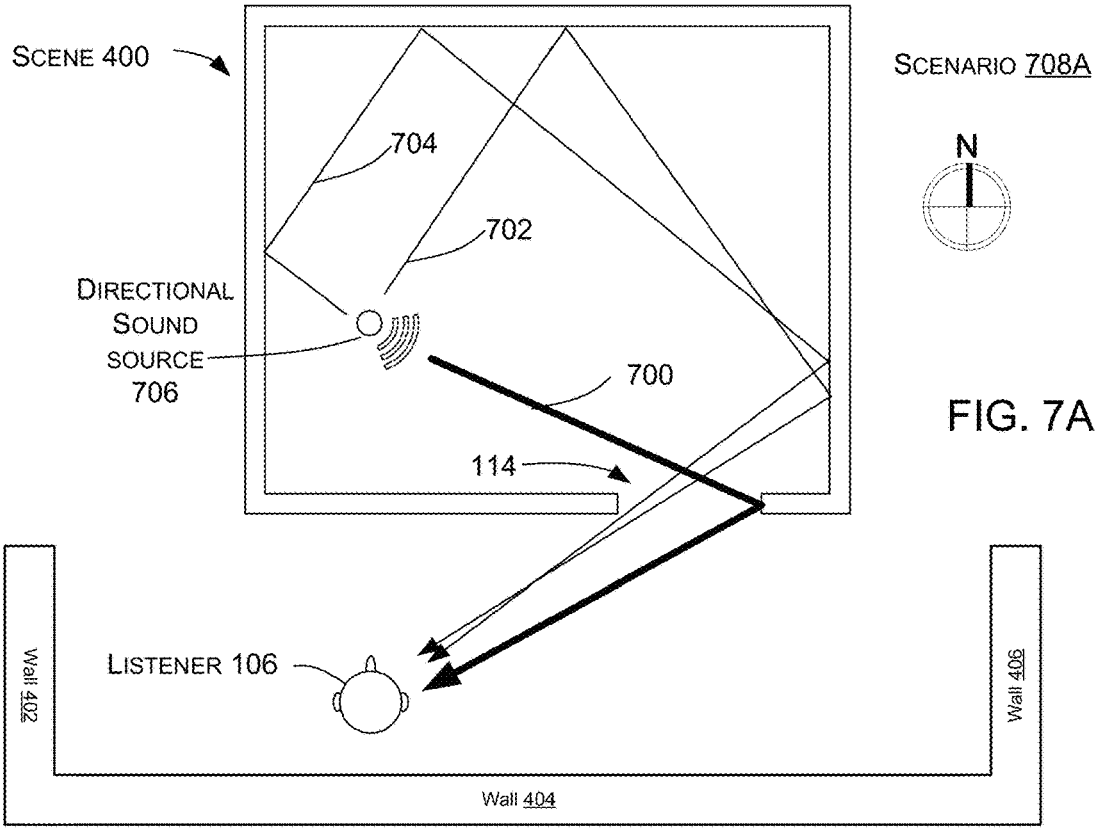
FIGS. 7A, 7B, and 7C illustrate scenarios related to rendering initial sound and reflections by adjusting power balance based on source directivity, consistent with some implementations of the present concepts.
Figure 7B:
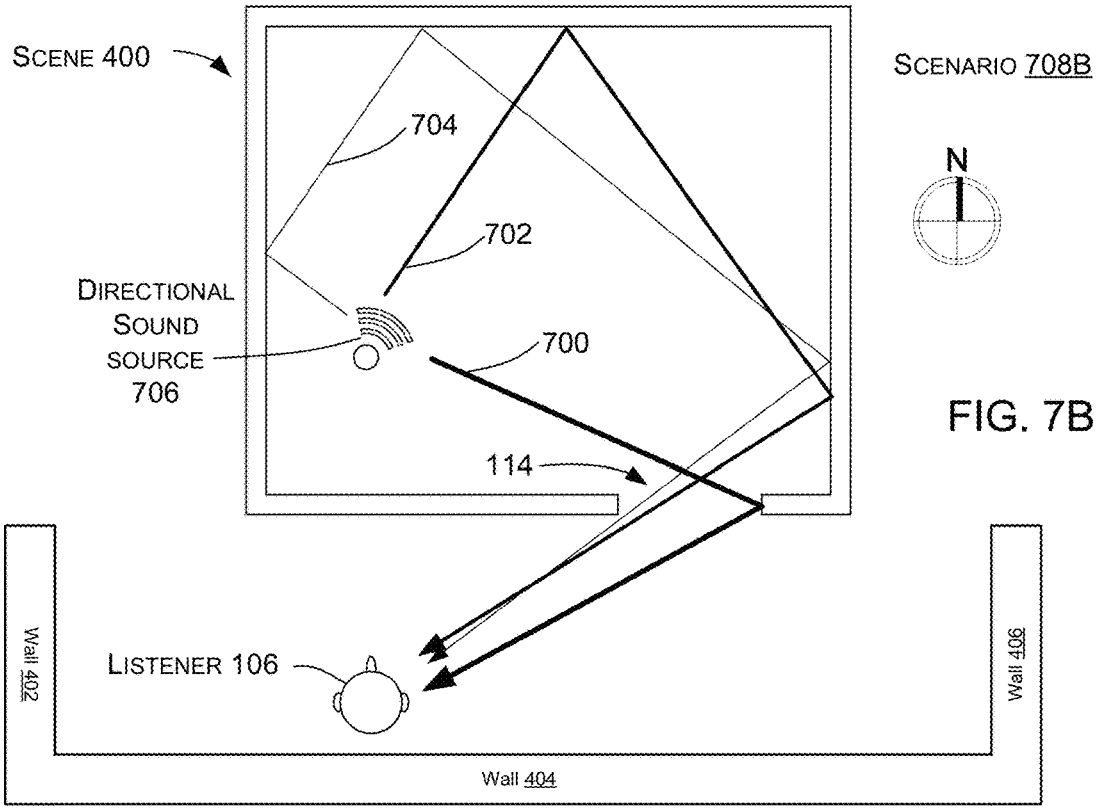
Figure 7C:
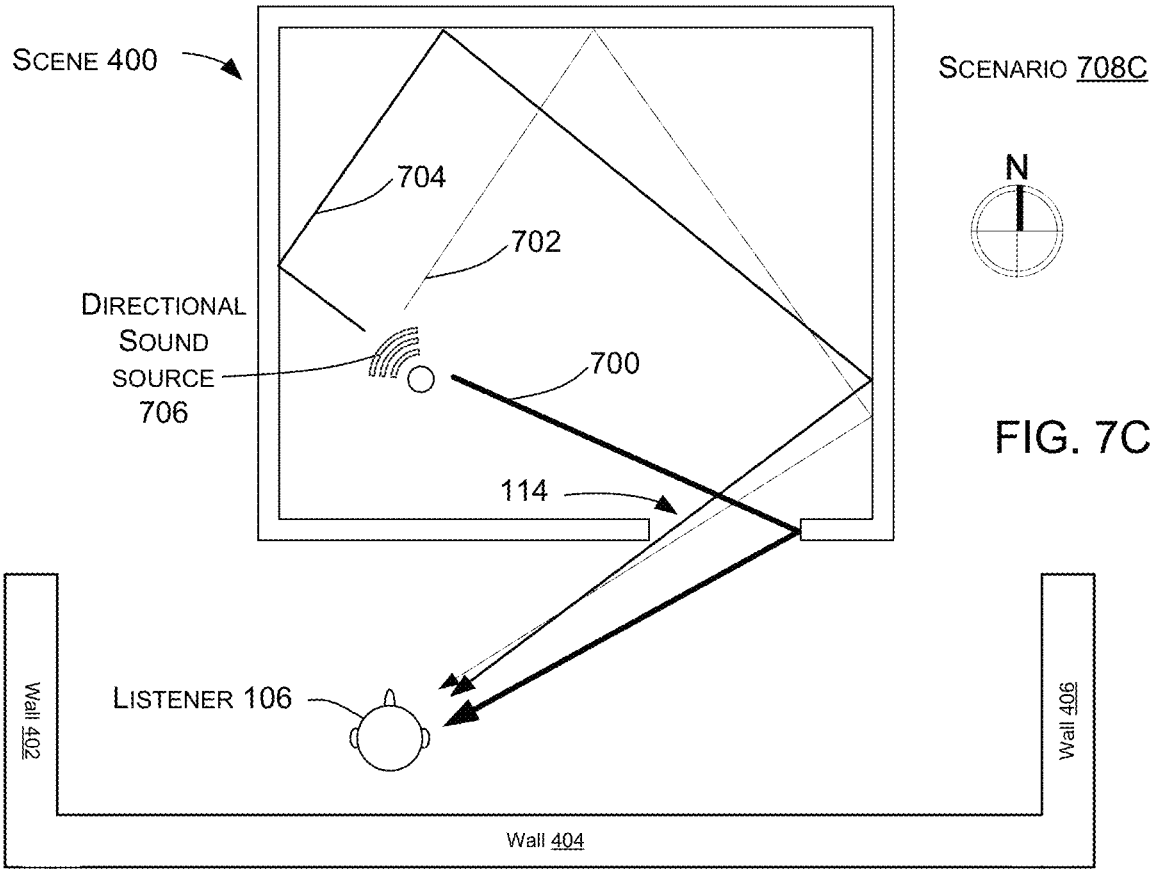

The aforementioned parameters can be employed for realistic rendering of directional sound. FIGS. 7A, 7B, and 7C illustrate how source directionality can affect how individual sound wavefronts are perceived. In particular, FIGS. 7A-7C illustrate how the power balance between initial wavefronts and reflection wavefronts can change as a function of the orientation of a directional source. In FIG. 7A, initial sound wavefront 700 is shown as well as reflection wavefronts 702 and 704. In FIG. 7A-7C, weighted lines are used, where the relative weight of each line is roughly proportional to the energy carried by the corresponding sound wavefront.

FIG. 7A illustrates a directional sound source 706 in a scenario 708A, where the directional sound source is facing toward portal 114. In this case, initial sound wavefront 700 is relatively loud and reflection wavefronts 702 and 704 are relatively quiet, due to the directivity of directional sound source 706.

FIG. 7B illustrates a scenario 708B, where directional sound source 706 is facing to the northeast. In this case, reflection wavefront 702 is somewhat louder than in scenario 708A, and initial sound wavefront 700 is somewhat quieter. Note that the initial sound wavefront still likely carries the most energy to the user and is still shown with the heaviest line weight, but the line weight is somewhat lighter than in scenario 708A to reflect the relative decrease in sound energy of the initial sound wavefront as compared to the previous scenario. Likewise, reflection wavefront 702 is illustrated as being somewhat heavier than in scenario 708A but still not as heavy as the initial sound wavefront, to show that this reflection wavefront has increased in sound energy relative to the previous scenario.

FIG. 7C illustrates a scenario 708C, where directional sound source 706 is facing to the northwest. In this case, reflection wavefront 704 is somewhat louder than was the case in scenarios 708A and 708B, and initial sound wavefront 700 is somewhat quieter than in scenario 708A. In a similar manner as discussed above with respect to scenario 708B, the initial sound wavefront still likely carries the most energy to the user but now reflection wavefront 704 carries somewhat more energy than was shown previously.

In general, the disclosed implementations allow for efficient rendering of initial sound and sound reflections to account for the orientation of a directional source. For instance, the disclosed implementations can render sounds that account for the change in power balance between initial sounds and reflections that occurs when a directional sound source changes orientation. In addition, the disclosed implementations can also account for how listener orientation can affect how the sounds are perceived, as described more below.

First Example System

In general, note that FIGS. 1-5, 6A, and 6B illustrate examples of acoustic parameters that can be encoded for various scenes. Further, note that these parameters can be generated using isotropic sound sources. At rendering time, directional sound sources can be accounted for when rendering sound as shown in FIGS. 7A-7C. Thus, as discussed more below, the disclosed implementations offer the ability to encode perceptual parameters using isotropic sources that nevertheless allow for runtime rendering of directional sound sources.

Figure 8:
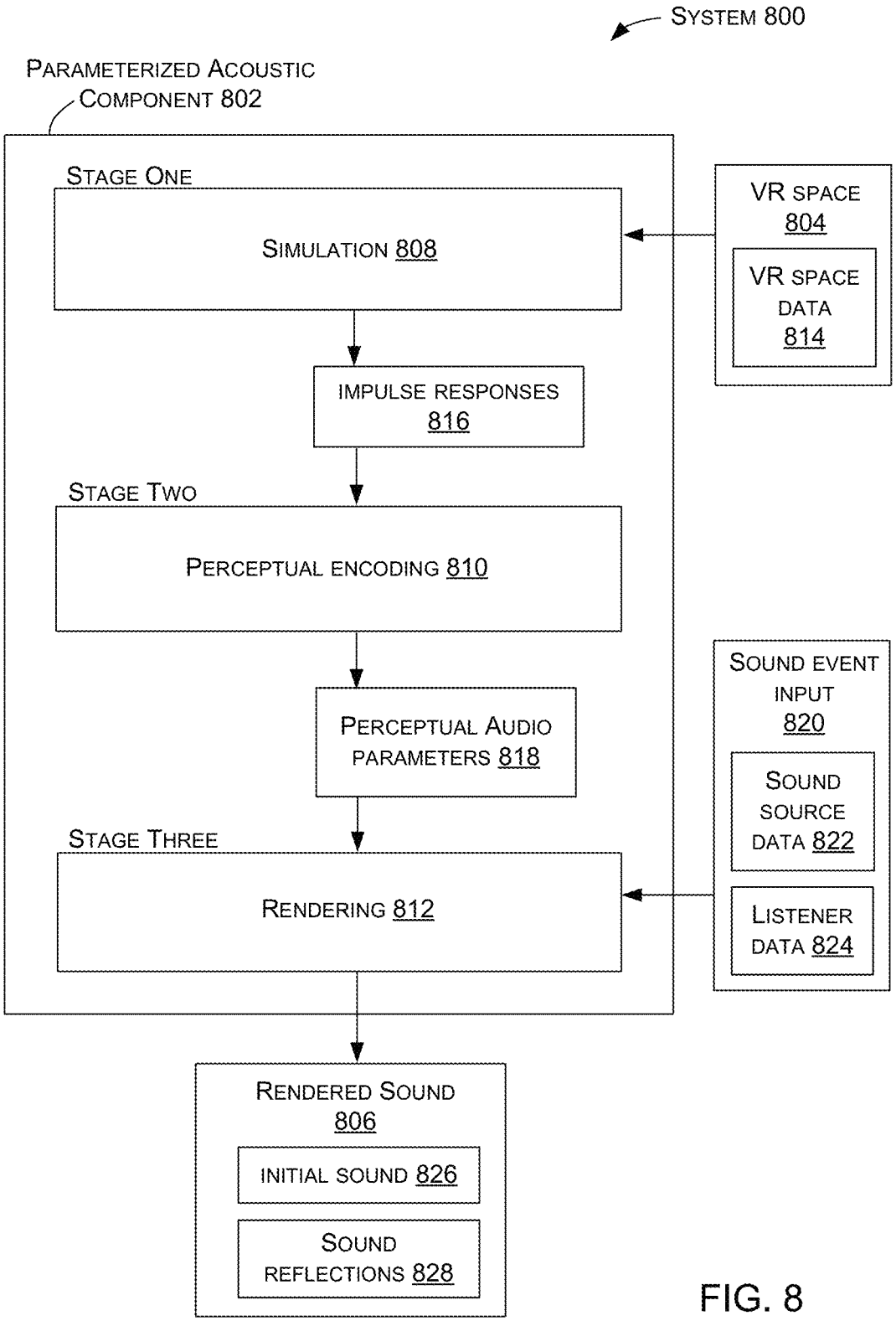
FIGS. 8 and 13 illustrate example systems that are consistent with some implementations of the present concepts.

A first example system 800 is illustrated in FIG. 8. In this example, system 800 can include a parameterized acoustic component 802. The parameterized acoustic component 802 can operate on a scene such as a virtual reality (VR) space 804. In system 800, the parameterized acoustic component 802 can be used to produce realistic rendered sound 806 for the virtual reality space 804. In the example shown in FIG. 8, functions of the parameterized acoustic component 802 can be organized into three Stages. For instance, Stage One can relate to simulation 808, Stage Two can relate to perceptual encoding 810, and Stage Three can relate to rendering 812. Also shown in FIG. 8, the virtual reality space 804 can have associated virtual reality space data 814. The parameterized acoustic component 802 can also operate on and/or produce impulse responses 816, perceptual acoustic parameters 818, and sound event input 820, which can include sound source data 822 and/or listener data 824 associated with a sound event in the virtual reality space 804. In this example, the rendered sound 806 can include rendered initial sound(s) 826 and/or rendered sound reflections 828.

As illustrated in the example in FIG. 8, at simulation 808 (Stage One), parameterized acoustic component 802 can receive virtual reality space data 814. The virtual reality space data 814 can include geometry (e.g., structures, materials of objects, etc.) in the virtual reality space 804, such as geometry 108 indicated in FIG. 1A. For instance, the virtual reality space data 814 can include a voxel map for the virtual reality space 804 that maps the geometry, including structures and/or other aspects of the virtual reality space 804. In some cases, simulation 808 can include directional acoustic simulations of the virtual reality space 804 to precompute sound wave propagation fields. More specifically, in this example simulation 808 can include generation of impulse responses 816 using the virtual reality space data 814. The impulse responses 816 can be generated for initial sounds and/or sound reflections. Stated another way, simulation 808 can include using a precomputed wave-based approach (e.g., pre-computed wave technique) to capture the complexity of the directionality of sound in a complex scene.

In some cases, the simulation 808 of Stage One can include producing relatively large volumes of data. For instance, the impulse responses 816 can be represented as 11-dimensional (11D) function associated with the virtual reality space 804. For instance, the 11 dimensions can include 3 dimensions relating to the position of a sound source, 3 dimensions relating to the position of a listener, a time dimension, 2 dimensions relating to the arrival direction of incoming sound from the perspective of the listener, and 2 dimensions relating to departure direction of outgoing sound from the perspective of the source. Thus, the simulation can be used to obtain an impulse response at each potential source and listener location in the scene. As discussed more below, perceptual acoustic parameters can be encoded from these impulse responses for subsequent rendering of sound in the scene.

One approach to encoding perceptual acoustic parameters 818 for virtual reality space 804 would be to generate impulse responses 816 for every combination of possible source and listener locations, e.g., every pair of voxels. While ensuring completeness, capturing the complexity of a virtual reality space in this manner can lead to generation of petabyte-scale wave fields. This can create a technical problem related to data processing and/or data storage. The techniques disclosed herein provide solutions for computationally efficient encoding and rendering using relatively compact representations.

For example, impulse responses 816 can be generated based on potential listener locations or "probes" scattered at particular locations within virtual reality space 804, rather than at every potential listener location (e.g., every voxel). The probes can be automatically laid out within the virtual reality space 804 and/or can be adaptively sampled. For instance, probes can be located more densely in spaces where scene geometry is locally complex (e.g., inside a narrow corridor with multiple portals), and located more sparsely in a wide-open space (e.g., outdoor field or meadow). In addition, vertical dimensions of the probes can be constrained to account for the height of human listeners, e.g., the probes may be instantiated with vertical dimensions that roughly account for the average height of a human being. Similarly, potential sound source locations for which impulse responses 816 are generated can be located more densely or sparsely as scene geometry permits. Reducing the number of locations within the virtual reality space 804 for which the impulse responses 816 are generated can significantly reduce data processing and/or data storage expenses in Stage One.

In some cases, virtual reality space 804 can have dynamic geometry. For example, a door in virtual reality space 804 might be opened or closed, or a wall might be blown up, changing the geometry of virtual reality space 804. In such examples, simulation 808 can receive virtual reality space data 814 that provides different geometries for the virtual reality space under different conditions, and impulse responses 816 can be computed for each of these geometries. For instance, opening and/or closing a door could be a regular occurrence in virtual reality space 804, and therefore representative of a situation that warrants modeling of both the opened and closed cases.

As shown in FIG. 8, at Stage Two, perceptual encoding 810 can be performed on the impulse responses 816 from Stage One. In some implementations, perceptual encoding 810 can work cooperatively with simulation 808 to perform streaming encoding. In this example, the perceptual encoding process can receive and compress individual impulse responses as they are being produced by simulation 808. For instance, values can be quantized (e.g., 3 dB for loudness) and techniques such as delta encoding can be applied to the quantized values. Unlike impulse responses, perceptual parameters tend to be relatively smooth, which enables more compact compression using such techniques. Taken together, encoding parameters in this manner can significantly reduce storage expense.

Generally, perceptual encoding 810 can involve extracting perceptual acoustic parameters 818 from the impulse responses 816. These parameters generally represent how sound from different source locations is perceived at different listener locations. Example parameters are discussed above with respect to FIGS. 2, 3, 5, and 6B. For example, the perceptual acoustic parameters for a given source/listener location pair can include initial sound parameters such as an initial delay period, initial departure direction from the source location, initial arrival direction at the listener location, and/or initial loudness. The perceptual acoustic parameters for a given source/listener location pair can also include reflection parameters such as a reflection delay period and an aggregate representation of bidirectional reflection loudness, as well as reverberation parameters such as a decay time. Encoding perceptual acoustic parameters in this manner can yield a manageable data volume for the perceptual acoustic parameters, e.g., in a relatively compact data file that can later be used for computationally efficient rendering.

With respect specifically to the aggregate representation of bidirectional reflection loudness, one approach is to define several coarse directions such as north, east, west, and south as shown in FIG. 5, as well as potentially up and down, as discussed more below. Generally, such a representation can convey, for each pair of source departure and listener arrival directions, the aggregate loudness of reflections for that direction pair. In the example of FIG. 5, each such representation has 16 total fields, e.g., a north-north field for reflection energy arriving at the north of the listener and emitted north of the source, a north-south field for reflection energy arriving at the north of the listener and emitted south of the source, and so on. In a case where the directions also include up and down, the representation can have 36 fields. Thus, for any pair of source and listener locations in a given scene, there can be 36 corresponding reflection loudness parameters, each of which accounts for a different combination of source departure direction and listener arrival direction.

The parameters for encoding reflections can also include a decay time of the reflections. For instance, the decay time can be a 60 dB decay time of sound response energy after an onset of sound reflections. In some cases, a single decay time is used for each source/location pair. In other words, the reflection parameters for a given location pair can include a single decay time together with a 36-field representation of reflection loudness.

Additional examples of parameters that could be considered with perceptual encoding 810 are contemplated. For example, frequency dependence, density of echoes (e.g., reflections) over time, directional detail in early reflections, independently directional late reverberations, and/or other parameters could be considered. An example of frequency dependence can include a material of a surface affecting the sound response when a sound hits the surface (e.g., changing properties of the resultant reflections).

As shown in FIG. 8, at Stage Three, rendering 812 can utilize the perceptual acoustic parameters 818 to render sound from a sound event. As mentioned above, the perceptual acoustic parameters 818 can be obtained in advance and stored, such as in the form of a data file. Rendering 812 can include decoding the data file. When a sound event in the virtual reality space 804 is received, it can be rendered using the decoded perceptual acoustic parameters 818 to produce rendered sound 806. The rendered sound 806 can include an initial sound(s) 826 and/or sound reflections 828, for example.

In general, the sound event input 820 shown in FIG. 8 can be related to any event in the virtual reality space 804 that creates a response in sound. For example, some sounds may be more or less isotropic, e.g., a detonating grenade or firehouse siren may tend to radiate more or less equally in all directions. Other sounds, such as the human voice, an audio speaker, or a brass or woodwind instrument tend to have directional sound.

The sound source data 822 for a given sound event can include an input sound signal for a runtime sound source, a location of the runtime sound source, and an orientation of the runtime sound source. For clarity, the term "runtime sound source" is used to refer to the sound source being rendered, to distinguish the runtime sound source from sound sources discussed above with respect to simulation and encoding of parameters. The sound source data can also convey directional characteristics of the runtime sound source, e.g., via a source directivity function (SDF).

Similarly, the listener data 824 can convey a location of a runtime listener and an orientation of the runtime listener. The term "runtime listener" is used to refer to the listener of the rendered sound at runtime, to distinguish the runtime listener from listeners discussed above with respect to simulation and encoding of parameters. The listener data can also convey directional hearing characteristics of the listener, e.g., in the form of a head-related transfer function (HRTF).

In some implementations, rendering 812 can include use of a lightweight signal processing algorithm. The lightweight signal processing algorithm can render sound in a manner that can be largely computationally cost-insensitive to a number of the sound sources and/or sound events. For example, the parameters used in Stage Two can be selected such that the number of sound sources processed in Stage Three does not linearly increase processing expense.

With respect to rendering initial loudness, the rendering can render an initial sound from the input sound signal that accounts for both runtime source and runtime listener location and orientation. For instance, given the runtime source and listener locations, the rendering can involve identifying the following encoded parameters that were precomputed in stage 2 for that location pair—initial delay time, initial loudness, departure direction, and arrival direction. The directivity characteristics of the sound source (e.g., the SDF)

can encode frequency-dependent, directionally-varying characteristics of sound radiation patterns from the source. Similarly, the directional hearing characteristics of the listener (e.g., HRTF) encode frequency-dependent, directionally-varying sound characteristics of sound reception patterns at the listener.

The sound source data for the input event can include an input signal, e.g., a time-domain representation of a sound such as series of samples of signal amplitude (e.g., 44100 samples per second). The input signal can have multiple frequency components and corresponding magnitudes and phases. In some implementations, the input time-domain signal is processed using an equalizer filter bank into different octave bands (e.g., nine bands) to obtain an equalized input signal.

Next, a lookup into the SDF can be performed by taking the encoded departure direction and rotating it into the local coordinate frame of the input source. This yields a runtime-adjusted sound departure direction that can be used to look up a corresponding set of octave-band loudness values (e.g., nine loudness values) in the SDF. Those loudness values can be applied to the corresponding octave bands in the equalized input signal, yielding nine separate distinct signals that can then be recombined into a single SDF-adjusted time-domain signal representing the initial sound emitted from the runtime source. Then, the encoded initial loudness value can be added to the SDF-adjusted time-domain signal.

The resulting loudness-adjusted time-domain signal can be input to a spatialization process to generate a binaural output signal that represents what the listener will hear in each ear. For instance, the spatialization process can utilize the HRTF to account for the relative difference between the encoded arrival direction and the runtime listener orientation. This can be accomplished by rotating the encoded arrival direction into the coordinate frame of the runtime listener's orientation and using the resulting angle to do an HRTF lookup. The loudness-adjusted time-domain signal can be convolved with the result of the HRTF lookup to obtain the binaural output signal. For instance, the HRTF lookup can include two different time-domain signals, one for each ear, each of which can be convolved with the loudness-adjusted time-domain signal to obtain an output for each ear. The encoded delay time can be used to determine the time when the listener receives the individual signals of the binaural output.

Using the approach discussed above, the SDF and source orientation can be used to determine the amount of energy emitted by the runtime source for the initial path. For instance, for a source with an SDF that emits relatively concentrated sound energy, the initial path might be louder relative to the reflections than for a source with a more diffuse SDF. The HRTF and listener orientation can be used to determine how the listener perceives the arriving sound energy, e.g., the balance of the initial sound perceived for each ear.

The rendering can also render reflections from the input sound signal that account for both runtime source and runtime listener location and orientation. For instance, given the runtime source and listener locations, the rendering can involve identifying the reflection delay period, the reverberation decay period, and the encoded directional reflection parameters (e.g., a matrix or other aggregate representation) for that specific source/listener location pair. These can be used to render reflections as follows.

The directivity characteristics of the source provided by the SDF convey loudness characteristics radiating in each axial direction, e.g., north, south, east, west, up, and down, and these can be adjusted to account for runtime source orientation. For instance, the SDF can include octave-band gains that vary as a function of direction relative to the runtime sound source. Each axial direction can be rotated into the local frame of the runtime sound source, and a lookup can be done into the smoothed SDF to obtain, for each octave, one gain per axial direction. These gains can be used to modify the input sound signal, yielding six time-domain signals, one per axial direction.

These six time-domain signals can then be scaled using the corresponding encoded directional reflectional parameters (e.g., loudness values in the matrix). For instance, the encoded loudness values can be used to obtain corresponding gains that are applied to the six time-domain signals. Once this is performed, the six time-domain signals represent the sound received at the listener from the six corresponding arrival directions.

Subsequently, these six time-domain signals can be processed using one or more reverb filters. For instance, the encoded decay time for the source/location pair can be used to interpolate among multiple canonical reverb filters. In a case with three reverb filters (short, medium, and long), the corresponding values can be stored in 18 separate buffers, one for each combination of reverb filter and axial direction. In cases where multiple sources are being rendered, the signals for those sources can be interpolated and added into these buffers in a similar manner. Then, the reverb filters can be applied via convolution operations and the results can be summed for each direction. This yields six buffers, each representing a reverberation signal arriving at the listener from one of the six directions, aggregated over one or more runtime sources The signals in these six buffers can be spatialized via the HRTF as follows. First, each of the six directions can be rotated into the runtime listener's local coordinate system, and then the resulting directions can be used for an HRTF lookup that yields two different time-domain signals. Each of the time-domain signals resulting from the HRTF lookup can be convolved with each of the six reverberation signals, yielding a total of 12 reverberation signals at the listener, six for each ear.

Applications

The parameterized acoustic component 802 can operate on a variety of virtual reality spaces 804. For instance, some examples of a video-game type virtual reality space 804 have been provided above. In other cases, virtual reality space 804 can be an augmented conference room that mirrors a real-world conference room. For example, live attendees could be coming and going from the real-world conference room, while remote attendees log in and out. In this example, the voice of a particular live attendee, as rendered in the headset of a remote attendee, could fade away as the live attendee walks out a door of the real-world conference room.

In other implementations, animation can be viewed as a type of virtual reality scenario. In this case, the parameterized acoustic component 802 can be paired with an animation process, such as for production of an animated movie. For instance, as visual frames of an animated movie are generated, virtual reality space data 814 could include geometry of the animated scene depicted in the visual frames. A listener location could be an estimated audience location for viewing the animation. Sound source data 822 could include information related to sounds produced by animated subjects and/or objects. In this instance, the parameterized acoustic component 802 can work cooperatively with an animation system to model and/or render sound to accompany the visual frames.

In another implementation, the disclosed concepts can be used to complement visual special effects in live action movies. For example, virtual content can be added to real world video images. In one case, a real-world video can be captured of a city scene. In post-production, virtual image content can be added to the real-world video, such as an animated character playing a trombone in the scene. In this case, relevant geometry of the buildings surrounding the corner would likely be known for the post-production addition of the virtual image content. Using the known geometry (e.g., virtual reality space data 814) and a position, loudness, and directivity of the trombone (e.g., sound event input 820), the parameterized acoustic component 802 can provide immersive audio corresponding to the enhanced live action movie. For instance, initial sound of the trombone can be made to grow louder when the bell of the trombone is pointed toward the listener and become quieter when bell of the trombone is pointed away from the listener. In addition, reflections can be relatively quieter when the when the bell of the trombone is pointed toward the listener and become relatively louder when bell of the trombone is pointed away from the listener toward a wall that reflects the sound back to the listener.

Overall, the parameterized acoustic component 802 can model acoustic effects for arbitrarily moving listener and/or sound sources that can emit any sound signal. The result can be a practical system that can render convincing audio in real-time. Furthermore, the parameterized acoustic component can render convincing audio for complex scenes while solving a previously intractable technical problem of processing petabyte-scale wave fields. As such, the techniques disclosed herein can handle be used to render sound for complex 3D scenes within practical RAM and/or CPU budgets. The result can be a practical system that can produce convincing sound for video games and/or other virtual reality scenarios in real-time.

Algorithmic Details

As noted, a corresponding source directivity function (SDF) can be obtained for each source to be rendered. For a given source, the SDF captures its far-field radiation pattern. In some implementations, the SDF representation represents the source per-octave and neglects phase. This can allow for use of efficient equalization filterbanks to manage per-source rendering cost. Note that the following discussion uses prime (*') to denote a property of the source, rather than time derivative.

Modeling

Interactive sound propagation aims to efficiently model the linear wave equation:

$$\left[\frac{1}{c^2}\partial_t^2 - \nabla_x^2\right]p(t, x; x') = \delta(t)\delta(x - x'), \tag{1}$$

where c=340 m/s is the speed of sound, $\nabla_x^2$ is the 3D Laplacian operator and δ the Dirac delta function representing an omnidirectional impulsive source located at x'. With boundary conditions provided by the shape and materials of the scene, the solution p(t, x; x') is the Green's function with the scene and source location, x', held fixed. In some implementations, stage one of system 800 involves using a time-domain wave solver to compute this field including diffraction and scattering effects directly on complex 3D scenes.

Monaural Rendering

The following discusses some mathematical background for rendering stage 812. Given an arbitrary pressure signal q'(t) radiating omnidirectionally from a sound source located at x', the resulting signal at a listener located at x can be computed using a temporal convolution, denoted by *:

$$q(t;x,x')=q'(t)*p(t;x,x'). \tag{2}$$

This modularizes the problem by separating source signal from environmental modification but ignores directional aspects of propagation.

Directional Listener

The notion of a (9D) listener directional impulse response d(t, s; x, x') generalizes the impulse response p(t; x, x') to include direction of arrival s. A tabulated head related transfer function (HRTF) comprising two spherical functions $H^{l/r}$ (s, t) can be used to specify the impulse response of acoustic transfer in the free field to the left and right ears. This allows directional rendering at the listener via:

$$q^{l/r}(t;x,x')=q'(t)*\int_{\mathcal{S}^2} d(t,s;x,x')*H^{l/r}(\mathcal{R}^{-1}(s),t)ds \tag{3}$$

where $\mathcal{R}$ is a rotation matrix mapping from head to world coordinate system, and $s\in\mathcal{S}^2$ represents the space of incident spherical directions forming the integration domain.

Directional Source and Listener

To account for directionality of the source, the bidirectional impulse response can be employed. The bidirectional impulse response can be an 11D function of the wave field, D (t, s, s'; x, x'). In a manner analogous to the HRTF, the source's radiation pattern is tabulated in a source directivity function (SDF), S(s, t). With this information, the following virtual acoustic rendering equation can be utilized for point-like sources:

$$q^{l/r}(t;x,x')=q'(t)*\iint_{\mathcal{S}^2} D(t,s,s';x,x')*H^{l/r}(\mathcal{R}^{-1}(s),t)*S(\mathcal{R}'^{-1}(s'),t)dsds'. \tag{4}$$

where $\mathcal{R}'$ is a rotation matrix mapping from the source to world coordinate system, and the integration becomes a double one over the space of both incident and emitted directions $s,s'\in\mathcal{S}^2$.

The bidirectional impulse response can be convolved with the source and listener's free-field directional responses S and $H^{l/r}$ respectively, while accounting for their rotation since (s,s') are in world coordinates, to capture modification due to directional radiation and reception. The integral repeats this for all combinations of (s,s'), yielding the net binaural response, which can then be convolved with the emitted signal q'(t) to obtain a binaural output that should be delivered to the entrances of the listener's ear canals.

The disclosed implementations can be employed to efficiently precompute the BIR field D(t, s, s', x, x') on complex scenes at stage 1, compactly encode this 11 D data using perception at stage 2, and approximate (4) for efficient rendering at stage 3, as discussed more below.

The bidirectional impulse response generalizes the listener directional impulse response (LDIR) used in (3) via $$d(t,s;x,x')=\int_{\mathcal{S}^2} D(t,s,s';x,x')ds'. \tag{5}$$

In other words, integrating over all radiating directions s' yields directional effects at the listener for an omnidirectional source. A source directional impulse response (SDIR) can be reciprocally defined as:

$$d'(t,s';x,x')=\int_{\mathcal{S}^2} D(t,s,s';x,x')ds. \tag{6}$$

representing directional source and propagation effects to an omnidirectional microphone at x via the rendering equation $$q(t;x,x')=q'(t)*\int_{\mathcal{S}^2} d'(t,s';x,x')*S(\mathcal{R}'^{-1}(s'),t)ds'. \tag{7}$$

Properties of the Bidirectional Decomposition

The formalization disclosed herein admits direct geometric interpretation. With source and listener located at (x', x) respectively, consider any pair of radiated and arrival directions (s', s). In general, multiple paths connect these pairs, (x',s') ⇝ (x, s), with corresponding delays and amplitudes, all of which are captured by D(t, s, s'; x, x'). The BIR is thus a fully reciprocal description of sound propagation within an arbitrary scene. Interchanging source and listener, propagation paths reverse:

$$D(t,s,s';x,x')=D(t,s',s;x',x). \tag{8}$$

This reciprocal symmetry mirrors that for the underlying wave field, p(t; x, x')=p(t; x', x), a property not shared by the listener directional impulse response d in (5). As discussed below, the complete reciprocal description can be used to extract source directionality with relatively little added cost.

Note how the disclosed formulation separates source signal, listener directivity, and source directivity, arranging the BIR field in D to characterize scene geometry and materials alone. This decomposition allows for various efficient approximations subsuming existing real-time virtual acoustic systems. In particular, this decomposition can provide for effective and efficient sound rendering when higher-order interactions between source/listener and scene predominate.

By separating properties of the environment from those of the source, the disclosed BIR formulation allows for practical precomputation that supports arbitrary movement and rotation of sources at runtime. In addition, Dirac-directional encoding for the initial (direct sound) response phase also spatializes more sharply.

Precomputation

The following describes how precompute and encode the bidirectional impulse response field D(t, s, s; x, x') from a set of wave simulations.

Extracting Directivity with Flux

One approach to precomputation samples the 7D Green's function p(t, x, x') and extracts directional information using a flux formulation first. Flux has been demonstrated to be effective for listener directivity in simulated wave fields. Flux density, or "flux" for short, measures the directed energy propagation density in a differential region of the fluid. For each impulsive wavefront passing over a point, flux instantaneously points in its propagating direction. It is computed for any volumetric transient field p(t, α; β) with listener at α and source at β as $$f_{\alpha\leftarrow\beta}(t,\alpha;\beta)\equiv -p(t,\alpha;\beta)v(t,\alpha;\beta), \tag{9}$$

$$v(t,\alpha;\beta)\equiv -\frac{1}{\rho_0}\int_{-\infty}^{t}\nabla_\alpha p(\tau,\alpha;\beta)d\tau,$$

where v is the particle velocity, and $\rho_0$ is the mean air density (1.225 kg/m3). Note the negative sign in the first equation that converts propagating to arrival direction at α. Flux can then be normalized to recover the time-varying unit direction, $$\hat{f}_{\alpha\leftarrow\beta}(t)\equiv f_{\alpha\leftarrow\beta}(t)/\|f_{\alpha\leftarrow\beta}(t)\|. \tag{10}$$

The bidirectional impulse response can be extracted as $$D(t,s,s';x,x')\approx\delta(s'-\hat{f}_{x'\leftarrow x}(t;x',x))\delta(s-\hat{f}_{x\leftarrow x'}(t;x,x'))p(t;x,x'). \tag{11}$$

At each instant in time t, the linear amplitude p is associated with the instantaneous direction of arrival at the listener $\hat{f}_{x\leftarrow x'}$ and direction of radiation from the source $\hat{f}_{x'\leftarrow x}$.

With relatively little error, flux approximates the directionality of energy propagation which can be analyzed with the much more costly reference of plane wave decomposition. One simplifying assumption is that sound has a single direction per time instant; in fact, energy can propagate in multiple directions simultaneously. However, because impulsive sound fields (those representing the response of a pulse) mostly consist of single moving wavefronts, especially in the initial, non-chaotic part of the response where directionality is particularly important.

Reciprocal Discretization

In some implementations, reciprocity is employed to make the precomputation more efficient by exploiting the fact that the runtime listener is typically more restricted in its motion than are sources. That is, the listener may tend to remain at roughly human height above floors or the ground in a scene. The term "probe" can be used for x representing listener location at runtime and source location during precomputation, and "receiver" for x'. By assuming that x varies more restrictively than x', one dimension can be saved from the set of probes. A set of probe locations for a given scene can be generated adaptively, while ensuring adequate sampling of walkable regions of the scene with spacing varying by a predetermined amount, e.g., 0.5 m and 3.5 m. Each probe can be processed independently in parallel over many cluster nodes.

For each probe, the scene's volumetric Green's function p(t,x';x) can be computed on a uniform spatio-temporal grid with resolution Δx=12.5 cm and Δt=170 μs, yielding a maximum usable frequency of $\nu_{max}$=1 kHz. In some implementations, the domain size is 90×90×30 m. The spatio-temporal impulse δ(t) δ(x'−x) can be introduced in the 3D scene and equation (1) can be solved using a pseudo-spectral solver. The frequency-weighted (perceptually equalized) pulse δ(t) and directivity at the listener in equation (11) can be computed as set forth below in the section entitled "Equalized Pulse", using additional discrete dipole source simulations to evaluate the gradient $\nabla_x p(t, x, x')$ required for computing $f_{x\leftarrow x'}$.

Source Directivity

Exploiting reciprocity per equation (8), directivity at runtime source location x' can be obtained by evaluating flux $f_{x'\leftarrow x}$ via equation (9). Because the volumetric field for each probe simulation p(t, x'; x) already varies over x', additional simulations may not be required. To compute the particle velocity, time integral and gradient can be commuted, yielding $$v(t,x';x)=-1/\rho_0\nabla_{x'}\int_{-\infty}^{t}p(\tau,x';x)d\tau.$$

An additional discrete field $$\int_{-\infty}^{t}p(\tau,x';x)d\tau$$

can be maintained and implemented as a running sum. Commutation saves memory by requiring additional storage for a scalar rather than a vector (gradient) field. The gradient can be evaluated at each step using centered differences. Overall, this provides a lightweight streaming implementation to compute $f_{x'\leftarrow x}$ in (11).

Perceptual Encoding

Extracting and encoding a directional response D(t, s, s'; x, x') can proceed independently for each (x, x') which, for brevity, is dropped from the notation in the following. At each solver time step t, the encoder receives the instantaneous radiation direction $f_{x'\leftarrow x}(t)$, the listener arrival direction $f_{x\leftarrow x'}(t)$, and the amplitude p(t).

The initial source direction can be computed as:

$$s'_0 \equiv \int_0^{\tau_0+1ms} f_{x'\leftarrow x}(t)dt, \tag{12}$$

where the delay of first arriving sound, $\tau_0$, is computed as described below in the section entitled "Initial Delay." The unit direction can be retained as the final parameter after integrating directions over a short (1 ms) window after $\tau_0$ to reproduce the precedence effect.

Reflections Transfer Matrix

One way to represent directional reflection characteristics of sound is in a "Reflections Transfer Matrix" or "RTM." To obtain the RTM for a given source/listener location, the directional loudness of reflections can be aggregated for 80 ms after the time when reflections first start arriving during simulation, denoted $\tau_1$. Directional energy can be collected using coarse cosine-squared basis functions fixed in world space and centered around the six Cartesian directions $X_*=\{\pm X, \pm Y, \pm Z\}$, $$w(s,X_*)\equiv(\max(s\cdot X_*,0))^2, \tag{13}$$

yielding the reflections transfer matrix:

$$R_{ij} \equiv 10\log_{10}\int_{\tau_0+10ms}^{\tau_1+80ms} w\left(\hat{f}_{x\leftarrow x'}(t), X_i\right)w\left(\hat{f}_{x'\leftarrow x}(t), X_j\right)p^2(t)dt. \tag{14}$$

Matrix component $R_{ij}$ encodes the loudness of sound emitted from the source around direction $X_j$ and arriving at the listener around direction $X_i$. At runtime, input gains in each direction around the source are multiplied by this matrix to obtain the propagated gains around the listener. Each of the 36 fields $R_{ij}(x'; x)$ is spatially smooth and compressible. The reflections transfer matrix can be quantized at 3 dB, down-sampled with spacing 1-1.5 m, passed through running differences along each X scanline, and finally compressed with LZW.

The total reflection energy arriving at an omnidirectional listener for each directional basis function at the source can be represented as:

$$R'_j \equiv 10\log_{10}\sum_{i=0}^{5} 10^{R_{ij}/10}, \tag{15}$$

Source Directivity Function

The following describes how to represent the source directivity function for a given source. Consider a free-field sound source at the origin and let the 3D position around it be expressed in spherical coordinates via x=r s. Its emitted field can be represented as q'(t)*p(s, r, t) where p(s, r, t) is its shape-dependent response including effects of self-scattering and self-shadowing, and q'(t) is the emitted sound signal that is modulated by such effects.

The radiated field at sufficient distance from any source can be expressed via the spherical multipole expansion:

$$p(s, r, t) \approx \frac{\delta(t-r/c)}{r}\sum_{m=0}^{M-1}\frac{\hat{p}_m(s, t)}{r^m}. \tag{16}$$

The above representation involves M temporal convolutions at runtime to apply the source directivity in a given direction s, which can be computationally expensive. Instead, some implementations assume a far-field (large r) approximation by dropping all terms m >0 yielding $$p(s,r,t)\approx\delta(t-r/c)(1/r)\hat{p}_0(s,t). \tag{17}$$

The first two factors represent propagation delay and monopole distance attenuation, already contained in the simulated BIR, leaving the source directivity function that can be the input to system 800: $S(s, t)\equiv\hat{p}_0(s, t)$. This represents the angular radiation pattern at infinity compensated for self-propagation effects. Measuring at the far field of a sound source is conveniently low-dimensional and data is available for many common sources.

S can further be approximated by removing phase information and averaging over perceptual frequency bands. Ignoring phase removes small fluctuations in frequency-dependent propagation delay due to source shape. Such fine-grained phase information improves near-field accuracy. Some implementations average over nine octave bands spanning the audible range with center angular frequencies: $\omega^k=2\pi\{62.5, 125, 250, 500, 1000, 2000, 4000, 8000, 17000\}$ Hz. Denoting temporal Fourier transform with $\mathcal{F}$, the following can be computed:

$$S^k(s) \equiv 10\log_{10}\left[\frac{\int_{\omega_k/\sqrt{2}}^{\omega_k\sqrt{2}} |\mathcal{F}\{S\}(s, \omega)|^2 d\omega}{\omega_k\left(\sqrt{2}-1/\sqrt{2}\right)}\right]. \tag{18}$$

The $\{S^k(s)\}$ thus form a set of real-valued spherical functions that capture salient source directivity information, such as the muffling of the human voice when heard from behind.

Each SDF octave $S^k$ can be sampled at an appropriate resolution, e.g., 2048 discrete directions placed uniformly over the sphere. It is given by $$S_G^k(s;\mu)\equiv e^{\lambda(k)(\mu\cdot s-1)} \tag{19}$$

where μ is the central axis of the lobe and λ(k) is the lobe sharpness, parameterized by frequency band. Some implementations employ a monotonically increasing function in our experiments, which models stronger shadowing behind the source as frequency increases.

Rendering Circuitry

Figure 9:
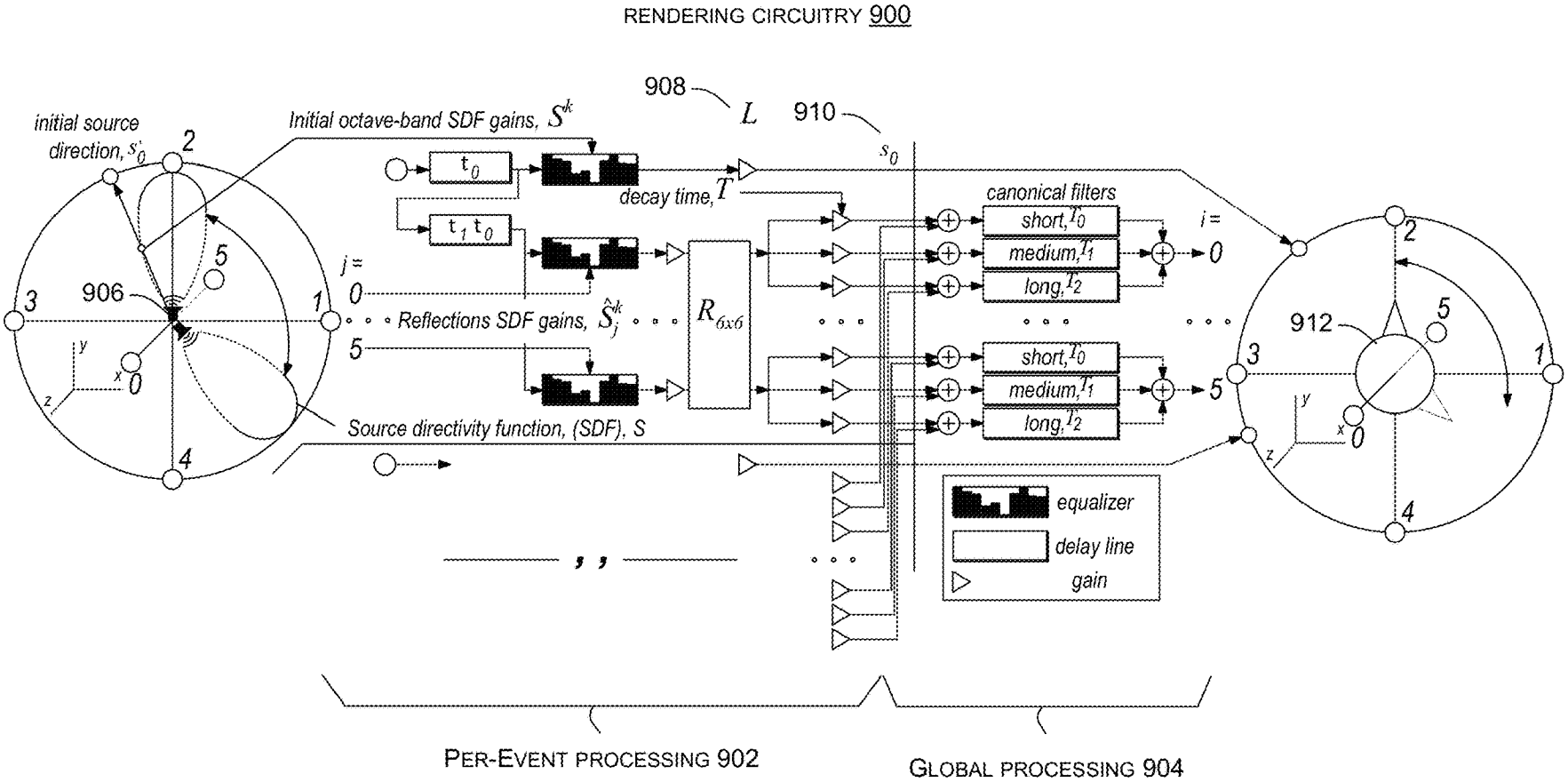
FIG. 9 illustrates a specific implementation of rendering circuitry that can be employed consistent with some implementations of the present concepts.

FIG. 9 illustrates rendering circuitry 900 that accounts for source directivity. In the following, index i is used for reflection directions around the listener, index j for reflection directions around the source, and index k for octaves. Generally, the rendering circuitry operates using per-sound event processing 902 for each sound event being rendered from one or more sources. Global processing 904 is employed on values that can be aggregated over multiple sound events.

Initial Sound Rendering

For initial sound, the encoded departure direction of the initial sound at a directional source 906 (also referenced herein as $s_{0'}$) is first transformed into the source's local reference frame. An SDF nearest-neighbor lookup can be performed to yield the octave-band loudness values:

$$L_k \equiv S^k(\mathcal{R}'^{-1}(s_{0'})) \tag{20}$$

due to the source's radiation pattern. These add to the overall direct loudness encoded as a separate initial loudness parameter 908, denoted L. Spatialization from the arrival direction 910 (also referenced herein as $s_0$) to the listener 912 can then be employed. As directional source 906 rotates, $\mathcal{R}'$ changes and the $L^k$ change accordingly.

Some implementations employ an equalization system to efficiently apply these octave loudnesses. Each octave can be processed separately and summed into the direct result via:

$$q^0(t) \equiv \sum_{k=0}^{8} 10^{(L+L_k)/20} B_k(t) * q'(t). \tag{21}$$

Each filter $B_k$ can be implemented as a series of 7 Butterworth bi-quadratic sections with each output feeding into the input of the next section. Each section contains a direct-form implementation of the recursion: $y[n] \leftarrow b_0 \cdot x[n] + b_1 \cdot x[n-1] + b_2 \cdot x[n-2] - a_1 \cdot y[n-1] - a_2 \cdot y[n-2]$) for input x, output y, and time step n. The output from the final section yields $B_k(t) * q'(t)$.

Reflections

Reflected energy transfer $R_{ij}$ represents smoothed information over directions using the cosine lobe w in equation (13). For rendering the SDF can be smoothed to obtain:

$$\hat{S}^k(s) \equiv \frac{\int_{S^2} S^k(u) w(s, u) du}{\int_{S^2} w(s, u) du}. \tag{22}$$

The source signal q'(t) can first be delayed by $\tau_1$ and then the following processing performed on it for each axial direction $X_j$. A lookup can be performed on the smoothed SDF to compute the octave-band gains:

$$\hat{S}_j^k \equiv \hat{S}^k(\mathcal{R}'^{-1}(X_j)). \tag{23}$$

These can be applied to the signal using an instance of the equalization filter bank as in equation (21) to yield the per-direction equalized signal $q'_j(t)$ radiating in six different aggregate directions j around the source:

$$q'_j(t) \equiv \sum_{k=0}^{8} \hat{S}_j^k B_k(t) * q'(t). \tag{24}$$

Next, the reflections transfer matrix can be applied to convert these to signals in different directions around the listener via $$q_i(t) \equiv \sum_{j=0}^{5} 10^{R_{ij}/20} q'_j(t). \tag{25}$$

The output signals $q_i$ represent signals to be spatialized from the world axial directions $X_i$ taking head rotation into account.

Listener Spatialization

Convolution with the HRTF $H^{l/r}$ in equation (4) can then be evaluated as described below in the section entitled "Binaural Rendering" to produce a binaural output. For direct sound, $s_0$ can transformed to the local coordinate frame of the head, $s_0^H \equiv \mathcal{R}^{-1}(s_0)$, and $q^0(t)$ spatialized in this direction. For indirect sound (reflections), each world coordinate axis can be transformed to the local coordinate of the head, $X_i^H \equiv \mathcal{R}^{-1}(X_i)$, and each $q_i(t)$ can be spatialized in the direction $X_i^H$.

A nearest-neighbor lookup in an HRTF dataset can be performed for each of these directions $s\psi \in \{s_0^H, X_i^H\}$, $i \in [0,5]$ to produce a corresponding time domain signal $H_\psi^{l/r}(t)$. A partitioned convolution in the frequency domain can be applied to produce a binaural output buffer at each audio tick, and the seven results can be summed (over ψ) at each ear.

Equalized Pulse

Figure 10A:
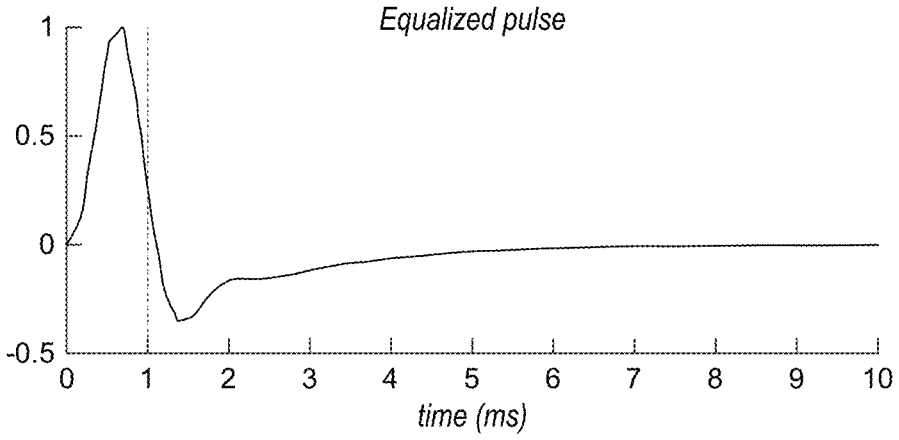
FIGS. 10A, 10B, and 10C show examples of equalized pulses, consistent with some implementations of the present concepts.
Figure 10B:
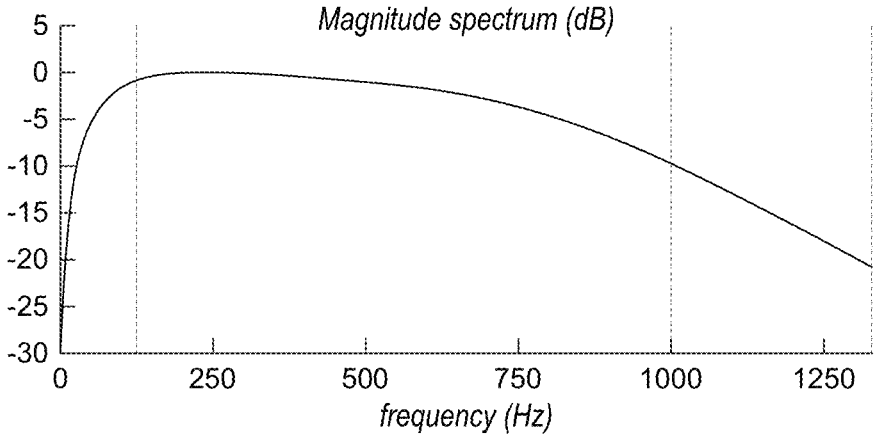
Figure 10C:
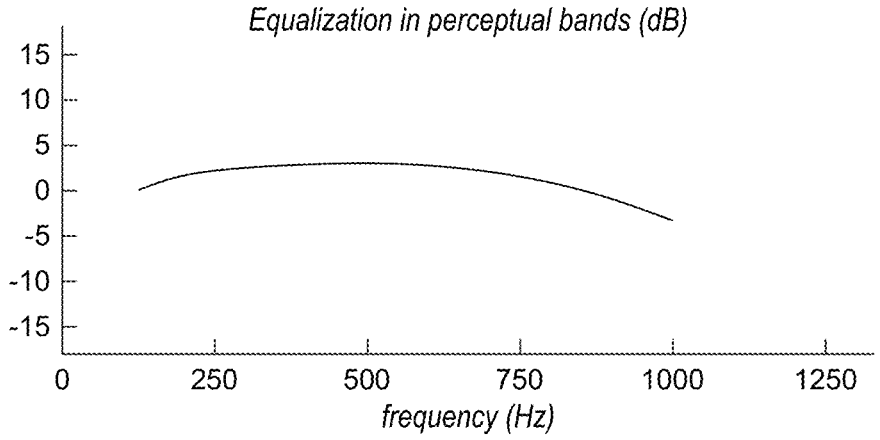

Encoder inputs {p(t), f(t)} can be responses to an impulse $\tilde{\delta}(t)$ provided to the solver. In some cases, an impulse function (FIGS. 10A-10C) can be designed to conveniently estimate the IR's energetic and directional properties without undue storage or costly convolution. FIG. 10A shows an equalized pulse $\tilde{\delta}(t)$ for $\nu_l$=125 Hz, $\nu_m$=1000 Hz and $\nu_m$=1333 Hz. As shown in FIG. 10A, the pulse can be designed to have a sharp main lobe (e.g., ~1 ms) to match auditory perception. As shown in FIG. 10B, the pulse can also have limited energy outside $[\nu_l, \nu_m]$, with smooth falloff which can minimize ringing in time domain. Within these constraints, the pulse can be designed to have matched energy (to within ±3 dB) in equivalent rectangular bands centered at each frequency, as shown in FIG. 10C.

In some implementations, the pulse can satisfy one or more of the following Conditions:

(1) Equalized to match energy in each perceptual frequency band. $\int p^2$ thus directly estimates perceptually weighted energy averaged over frequency.

(2) Abrupt in onset, critical for robust detection of initial arrival. Accuracy of about 1 ms or better, for example, when estimating the initial arrival time, matching auditory perception.

(3) Sharp in main peak with a half-width of less than 1 ms, for example. Flux merges peaks in the time-domain response; such mergers can be similar to human auditory perception.

(4) Anti-aliased to control numerical error, with energy falling off steeply in the frequency range $[\nu_m, \nu_M]$.

(5) Mean-free. In some cases, sources with substantial DC energy can yield residual particle velocity after curved wavefronts pass, making flux less accurate. Reverberation in small rooms can also settle to a non-zero value, spoiling energy decay estimation.

(6) Quickly decaying to minimize interference between flux from neighboring peaks. Note that abrupt cutoffs at $\nu_m$ for Condition (4) or at DC for Condition (5) can cause non-compact ringing.

Human pitch perception can be roughly characterized as a bank of frequency-selective filters, with frequency-dependent bandwidth known as Equivalent Rectangular Bandwidth (ERB). The same notion underlies the Bark psychoacoustic scale consisting of 24 bands equidistant in pitch and utilized by the PWD visualizations described above.

A simple model for ERB around a given center frequency ν in Hz is given by $B(\nu) \equiv 24.7\ (4.37\ \nu/1000+1)$. Condition (1) above can then be met by specifying the pulse's energy spectral density (ESD) as $1/B(\nu)$. However, in some cases this can violate Conditions (4) and (5). Therefore, the modified ESD can be substituted $$E(\nu) = \frac{1}{B(\nu)} \frac{1}{|1 + 0.55(2i\nu/\nu_h) - (\nu/\nu_h)^2|^4} \frac{1}{|1 + i\nu/\nu_l|^2} \tag{26}$$

where $\nu_l$=125 Hz can be the low and $\nu_h$=0.95 $\nu_m$ the high frequency cutoff. The second factor can be a second-order low-pass filter designed to attenuate energy beyond $\nu_m$ per Condition (4) while limiting ringing in the time domain via the tuning coefficient 0.55 per Condition (6). The last factor combined with a numerical derivative in time can attenuate energy near DC, as explained more below.

A minimum-phase filter can then be designed with E(ν) as input. Such filters can manipulate phase to concentrate energy at the start of the signal, satisfying Conditions (2) and (3). To make DC energy 0 per Condition (5), a numerical derivative of the pulse output can be computed by minimum-phase construction. The ESD of the pulse after this derivative can be $4\pi^2\nu^2E(\nu)$. Dropping the $4\pi^2$ and grouping the $\nu^2$ with the last factor in Equation (14) can yield $\nu^2/|1+i\nu/\nu_l|^2$, representing the ESD of a first-order high-pass filter with 0 energy at DC per Condition (5) and smooth tapering in $[0,\nu_l]$ which can control the negative side lobe's amplitude and width per Condition (6). The output can be passed through another low-pass $L_{\nu h}$ to further reduce aliasing, yielding the final pulse shown in FIG. 10A.

Initial Delay (Onset)

Figure 11A:
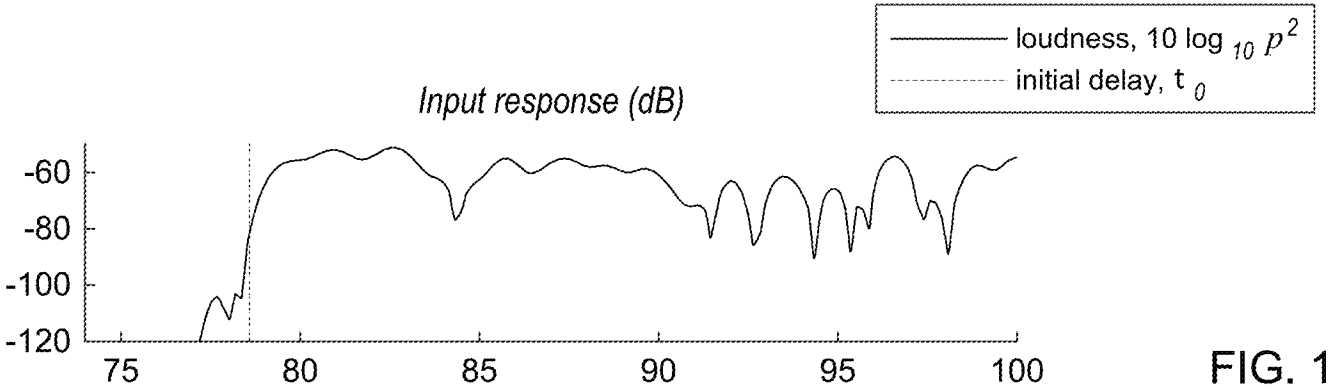
FIGS. 11A and 11B show examples of initial delay processing, consistent with some implementations of the present concepts.
Figure 11B:
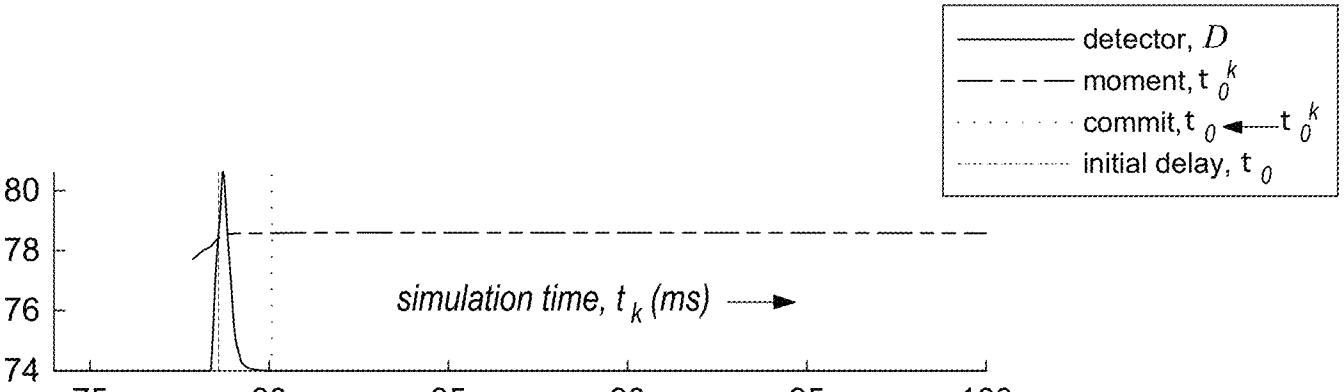

FIGS. 11A and 11B illustrate processing to identify initial delay from an actual response from an actual video game scene. The solver can fix the emitted pulse's amplitude so the received signal at 1 m distance (for example) in the free field can have unit energy, $\int p^2=1$. In some cases, initial delay could be computed by comparing incoming energy $p^2$ to an absolute threshold. In other cases, such as occluded cases, a weak initial arrival can rise above threshold at one location and stay below at a neighbor, which can cause distracting jumps in rendered delay and direction at runtime.

In some cases, in a robust detector D, initial delay can be computed as its first moment, $\tau_0 \equiv \int tD(t)/\int D(t)$, where $$D(t) \equiv \left[\frac{d}{dt}\left(\frac{E(t)}{E(t-\Delta t)+\epsilon}\right)\right]^n \tag{27}$$

Here, $E(t) \equiv \mathcal{L}_{\nu m/4} * \int P^2$ and $\in=10^{-11}$. E can be a monotonically increasing, smoothed running integral of energy in the pressure signal. The ratio in Equation (27) can look for jumps in energy above a noise floor E. The time derivative can then peak at these jumps and descend to zero elsewhere, for example, as shown in FIGS. 11A and 11B. (In FIGS. 11A and 11B, D is scaled to span the y-axis.) In some cases, for the detector to peak, energy can abruptly overwhelm what has been accumulated so far. The detector's peakedness can be controlled using n=2, for example.

This detector can be streamable. $\int p^2$ can be implemented as a discrete accumulator. $\mathcal{L}$ can be a recursive filter, which can use an internal history of one past input and output, for example. One past value of E can be used for the ratio, and one past value of the ratio kept to compute the time derivative via forward differences. However, computing onset via first moment can pose a problem as the entire signal must be processed to produce a converged estimate.

The detector can be allowed some latency, for example 1 ms for summing localization. A running estimate of the moment can be kept, $$\tau_0^k = \int_0^{t_k} tD(t) \Big/ \int_0^{t_k} D(t)$$

and a detection can be committed $\tau_0 \leftarrow \tau_0^k$ when it stops changing; that is, the latency can satisfy $t_{k-1}-\tau_0^{k-1}<1$ ms and $t_k-\tau_0^k>1$ ms (see the dotted line in FIGS. 11A and 11B). In some cases, this detector can trigger more than once, which can indicate the arrival of significant energy relative to the current accumulation in a small time interval. This can allow the last to be treated as definitive. Each commit can reset the subsequent processing state as necessary.

Binaural Rendering

The response of an incident plane wave field $\delta(t+s\cdot\Delta x/c)$ from direction s can be recorded at the left and right ears of a listener (e.g., user, person). Δx denotes position with respect to the listener's head centered at x. Assembling this information over all directions can yield the listener's Head-Related Transfer Function (HRTF), denoted $h^{L/R}(s, t)$. Low-to-mid frequencies (<1000 Hz) correspond to wavelengths that can be much larger than the listener's head and can diffract around the head. This can create a detectable time difference between the two ears of the listener. Higher frequencies can be shadowed, which can cause a significant loudness difference. These phenomena, respectively called the interaural time difference (ITD) and the interaural level difference (ILD), can allow localization of sources. Both can be considered functions of direction as well as frequency, and can depend on the particular geometry of the listener's pinna, head, and/or shoulders.

Given the HRTF, rotation matrix R mapping from head to world coordinate system, and the DIR field absent the listener's body, binaural rendering can reconstruct the signals entering the two ears, $q^{L/R}$ via $$q^{L/R}(t;x,x')=\tilde{q}(t)*p^{L/R}(t;x,x') \tag{28}$$

where $p^{L/R}$ can be the binaural impulse response $$p^{L/R}(t;x,x')=\int_{s^2} d(s,t;x,x')*h^{L/R}(R^{-1}(s),t)ds \tag{29}$$

Here $S^2$ indicates the spherical integration domain and ds the differential area of its parameterization, $s \in S^2$. Note that in audio literature, the terms "spatial" and "spatialization" can refer to directional dependence (on s) rather than source/listener dependence (on x and x').

A generic HRTF dataset can be used, combining measurements across many subjects. For example, binaural responses can be sampled for $N_H$=2048 discrete directions $\{s_j\}$, $j \in [0, N_H-1]$ uniformly spaced over the sphere. Other examples of HRTF datasets are contemplated for use with the present concepts.

Experimental Results

Refer back to FIGS. 2 and 3, which illustrate departure and arrival direction fields for a scene 200, as described above. These fields represent experimental results obtained by performing the simulation and encoding techniques described above on scene 200.

In addition, the disclosed simulation and encoding techniques were performed on scene 200 to yield reflection magnitudes shown in FIGS. 12A-12E. In each of these figures, the relative density of the stippling is proportional to the loudness of reflections received at the listener location 204, summed over all arrival directions at the listener and departing in different directions from the source locations.

Figure 12A:
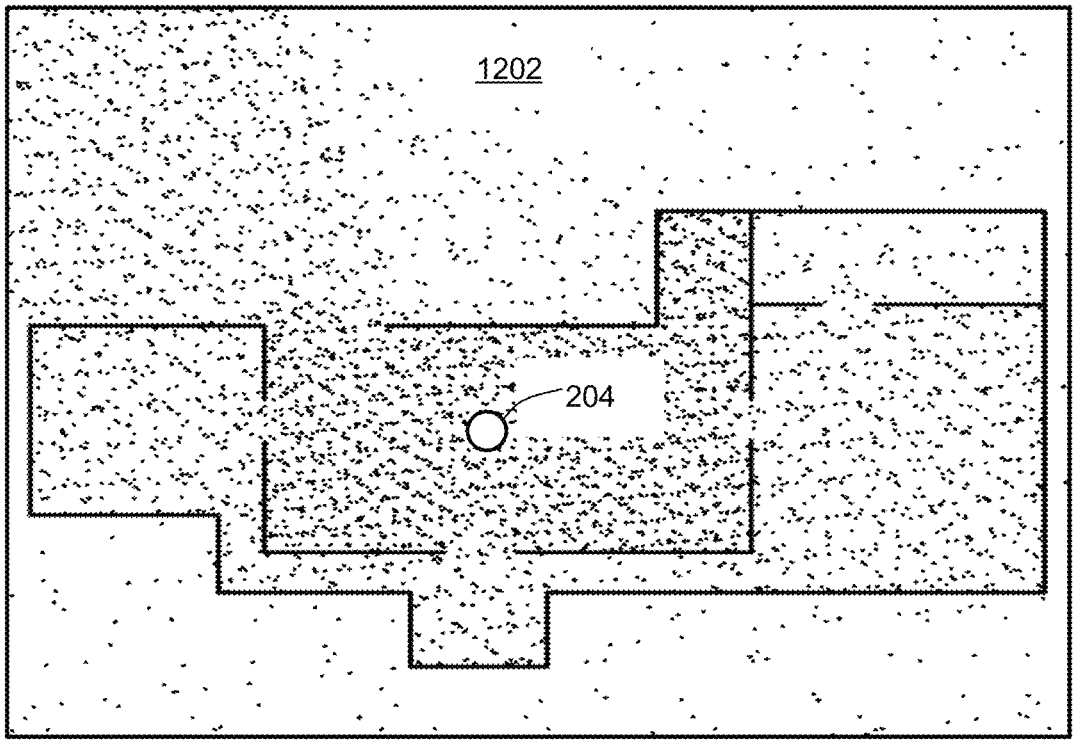
FIGS. 12A-12F show examples of reflection magnitude fields for a scene, consistent with some implementations of the present concepts.
Figure 12B:
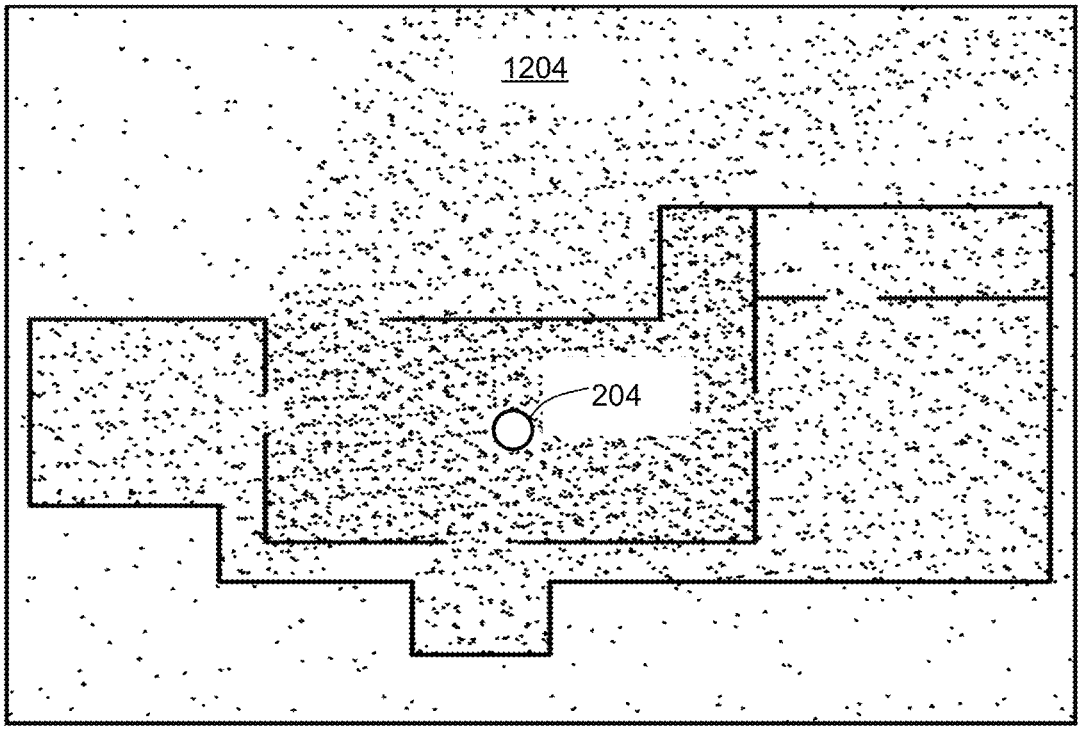
Figure 12C:
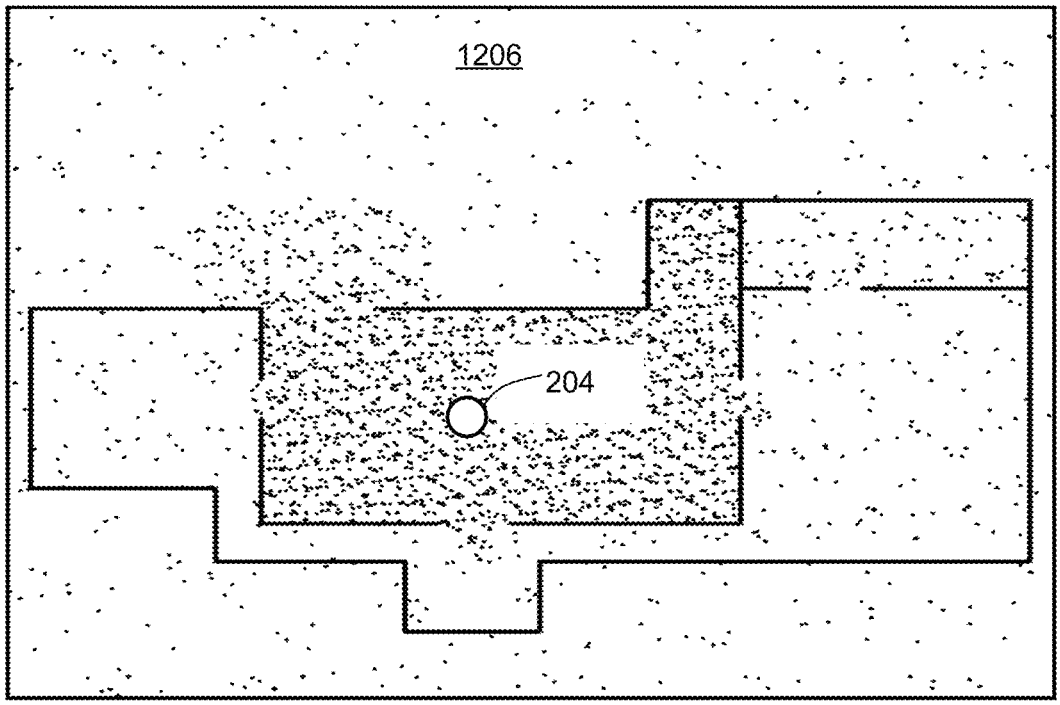
Figure 12D:
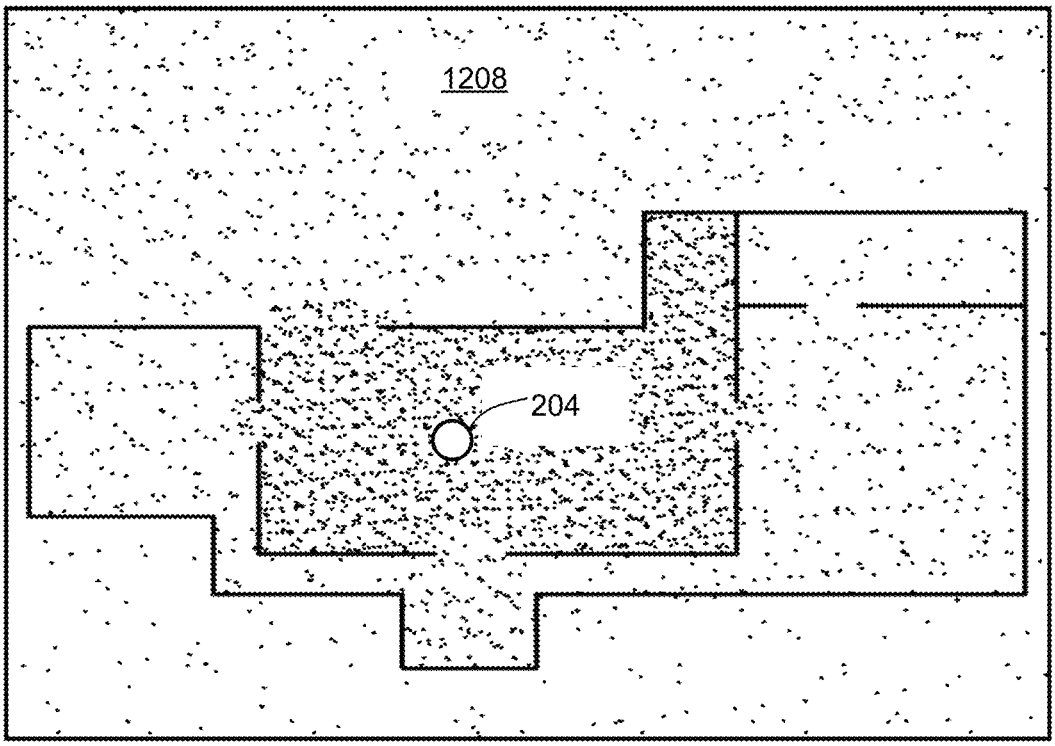
Figure 12E:
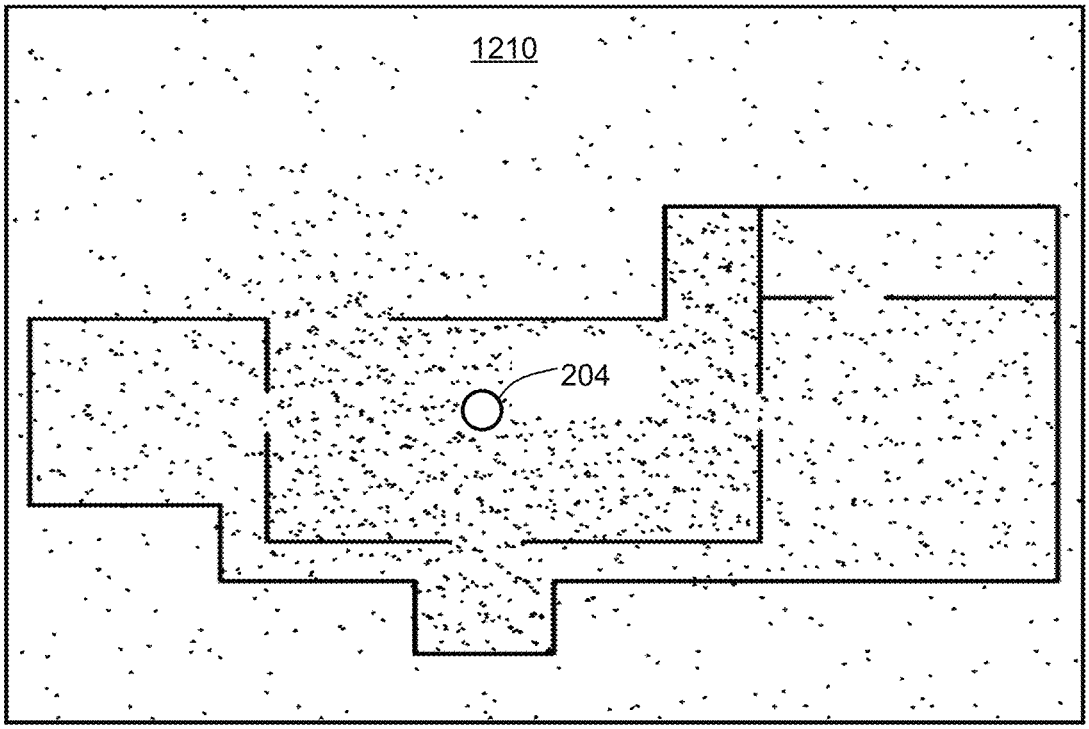
Figure 12F:
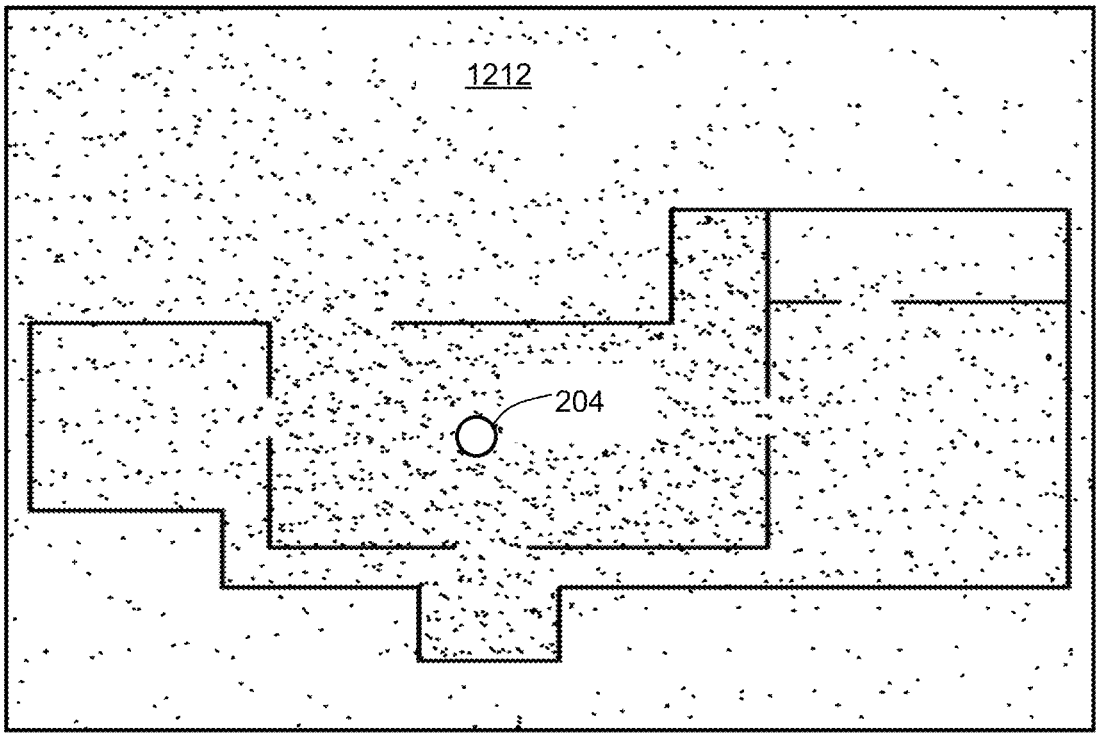

For instance, FIG. 12A shows a reflections magnitude field 1202 that represents the loudness of reflections arriving at the listener location for sounds departing east from respective source locations. FIG. 12B shows a reflections magnitude field 1204 that represents the loudness of reflections arriving at the listener location for sounds departing to the west. FIG. 12C shows a reflections magnitude field 1206 that represents the loudness of reflections arriving at the listener location for sounds departing to the north. FIG. 12D shows a reflections magnitude field 1208 that represents the loudness of reflections arriving at the listener location for sounds departing to the south. FIG. 12E shows a reflections magnitude field 1210 that represents the loudness of reflections arriving at the listener location for sounds departing vertically upward. FIG. 12F shows a reflections magnitude field 1212 that represents the loudness of reflections arriving at the listener location for sounds departing vertically downward.

Example System

Figure 13:
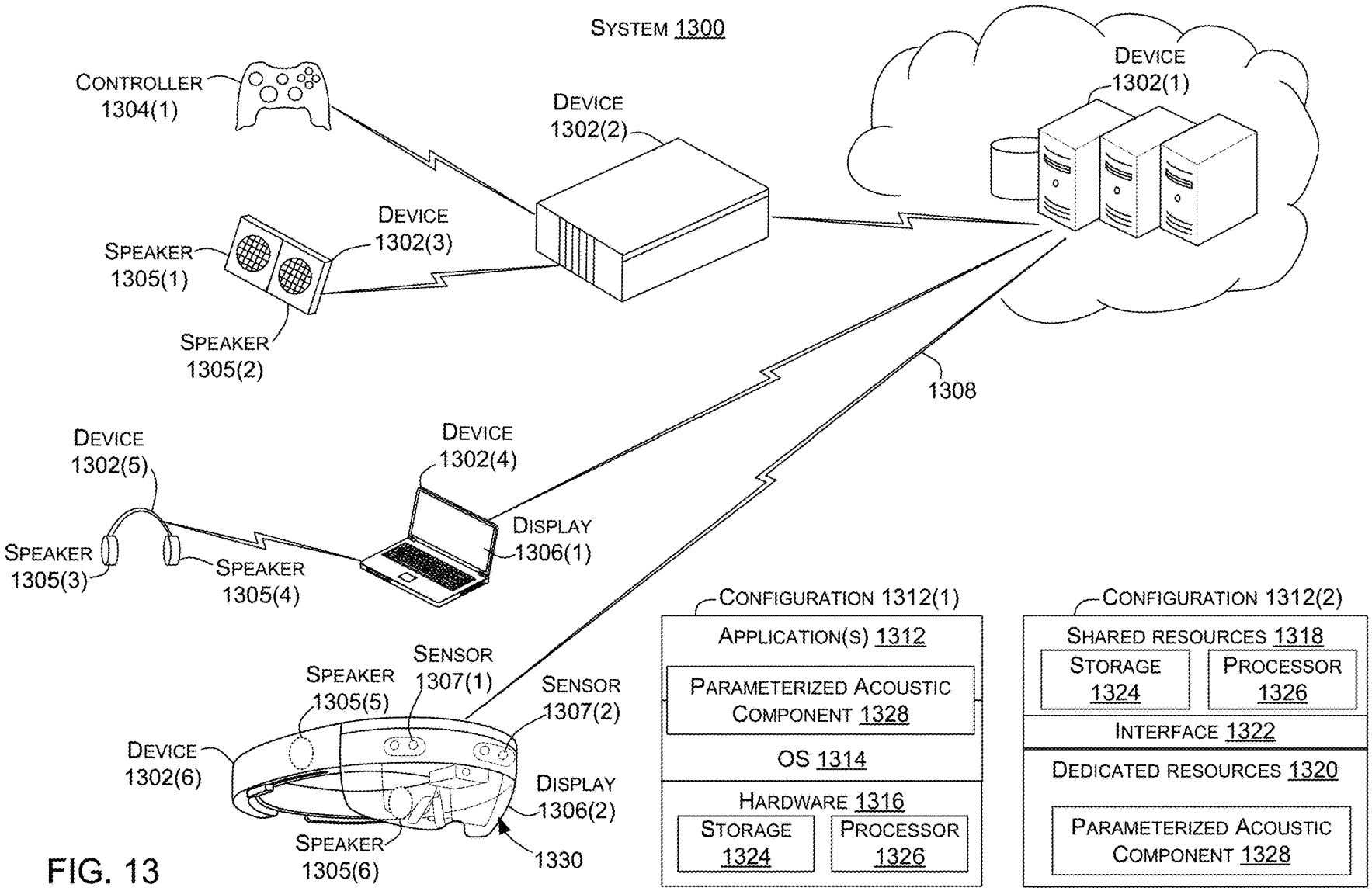

FIG. 13 shows a system 1300 that can accomplish parametric encoding and rendering as discussed herein. For purposes of explanation, system 1300 can include one or more devices 1302. The device may interact with and/or include controllers 1304 (e.g., input devices), speakers 1305, displays 1306, and/or sensors 1307. The sensors can be manifest as various 2D, 3D, and/or microelectromechanical systems (MEMS) devices. The devices 1302, controllers 1304, speakers 1305, displays 1306, and/or sensors 1307 can communicate via one or more networks (represented by lightning bolts 1308).

In the illustrated example, example device 1302(1) is manifest as a server device, example device 1302(2) is manifest as a gaming console device, example device 1302(3) is manifest as a speaker set, example device 1302(4) is manifest as a notebook computer, example device 1302(5) is manifest as headphones, and example device 1302(6) is manifest as a virtual reality device such as a head-mounted display (HMD) device. While specific device examples are illustrated for purposes of explanation, devices can be manifest in any of a myriad of ever-evolving or yet to be developed types of devices.

In one configuration, device 1302(2) and device 1302(3) can be proximate to one another, such as in a home video game type scenario. In other configurations, devices 1302 can be remote. For example, device 1302(1) can be in a server farm and can receive and/or transmit data related to the concepts disclosed herein.

FIG. 13 shows two device configurations 1310 that can be employed by devices 1302. Individual devices 1302 can employ either of configurations 1310(1) or 1310(2), or an alternate configuration. (Due to space constraints on the drawing page, one instance of each device configuration is illustrated rather than illustrating the device configurations relative to each device 1302.) Briefly, device configuration 1310(1) represents an operating system (OS) centric configuration. Device configuration 1310(2) represents a system on a chip (SOC) configuration. Device configuration 1310(1) is organized into one or more application(s) 1312, operating system 1314, and hardware 1316. Device configuration 1310(2) is organized into shared resources 1318, dedicated resources 1320, and an interface 1322 there between.

In either configuration 1310, the device can include storage/memory 1324, a processor 1326, and/or a parameterized acoustic component 1328. In some cases, the parameterized acoustic component 1328 can be similar to the parameterized acoustic component 802 introduced above relative to FIG. 8. The parameterized acoustic component 1328 can be configured to perform the implementations described above and below.

In some configurations, each of devices 1302 can have an instance of the parameterized acoustic component 1328. However, the functionalities that can be performed by parameterized acoustic component 1328 may be the same or they may be different from one another. In some cases, each device's parameterized acoustic component 1328 can be robust and provide all of the functionality described above and below (e.g., a device-centric implementation). In other cases, some devices can employ a less robust instance of the parameterized acoustic component that relies on some functionality to be performed remotely. For instance, the parameterized acoustic component 1328 on device 1302(1) can perform functionality related to Stages One and Two, described above for a given application, such as a video game or virtual reality application. In this instance, the parameterized acoustic component 1328 on device 1302(2) can communicate with device 1302(1) to receive perceptual acoustic parameters 818. The parameterized acoustic component 1328 on device 1302(2) can utilize the perceptual parameters with sound event inputs to produce rendered sound 806, which can be played by speakers 1305(1) and 1305(2) for the user.

In the example of device 1302(6), the sensors 1307 can provide information about the orientation of a user of the device (e.g., the user's head and/or eyes relative to visual content presented on the display 1306(2)). The orientation can be used for rendering sounds to the user by treating the user as a listener or, in some cases, as a sound source. In device 1302(6), a visual representation 1330 (e.g., visual content, graphical use interface) can be presented on display 1306(2). In some cases, the visual representation can be based at least in part on the information about the orientation of the user provided by the sensors. Also, the parameterized acoustic component 1328 on device 1302(6) can receive perceptual acoustic parameters from device 1302(1). In this case, the parameterized acoustic component 1328(6) can produce rendered sound that has accurate directionality in accordance with the representation. Stated another way, stereoscopic sound can be rendered through the speakers 1305(5) and 1305(6) in proper orientation to a visual scene or environment, to provide convincing sound to enhance the user experience.

In still another case, Stage One and Two described above can be performed responsive to inputs provided by a video game and/or virtual reality application. The output of these stages, e.g., perceptual acoustic parameters 818, can be added to the video game as a plugin that also contains code for Stage Three. At run time, when a sound event occurs, the plugin can apply the perceptual parameters to the sound event to compute the corresponding rendered sound for the sound event. In other implementations, the video game and/or virtual reality application can provide sound event inputs to a separate rendering component (e.g., provided by an operating system) that renders directional sound on behalf of the video game and/or virtual reality application.

In some cases, the disclosed implementations can be provided by a plugin for an application development environment. For instance, an application development environment can provide various tools for developing video games, virtual reality applications, and/or architectural walkthrough applications. These tools can be augmented by a plugin that implements one or more of the stages discussed above. For instance, in some cases, an application developer can provide a description of a scene to the plugin, and the plugin can perform the disclosed simulation techniques on a local or remote device, and output encoded perceptual parameters for the scene. In addition, the plugin can implement scene-specific rendering given an input sound signal and information about source and listener locations and orientations, as described above.

The term "device," "computer," or "computing device" as used herein can mean any type of device that has some amount of processing capability and/or storage capability. Processing capability can be provided by one or more processors that can execute computer-readable instructions to provide functionality. Data and/or computer-readable instructions can be stored on storage, such as storage that can be internal or external to the device. The storage can include any one or more of volatile or non-volatile memory, hard drives, flash storage devices, and/or optical storage devices (e.g., CDs, DVDs etc.), remote storage (e.g., cloud-based storage), among others. As used herein, the term "computer-readable media" can include signals. In contrast, the term "computer-readable storage media" excludes signals. Computer-readable storage media includes "computer-readable storage devices." Examples of computer-readable storage devices include volatile storage media, such as RAM, and non-volatile storage media, such as hard drives, optical discs, and flash memory, among others.

As mentioned above, device configuration 1310(2) can be thought of as a system on a chip (SOC) type design. In such a case, functionality provided by the device can be integrated on a single SOC or multiple coupled SOCs. One or more processors 1326 can be configured to coordinate with shared resources 1318, such as storage/memory 1324, etc., and/or one or more dedicated resources 1320, such as hardware blocks configured to perform certain specific functionality. Thus, the term "processor" as used herein can also refer to central processing units (CPUs), graphical processing units (GPUs), field programmable gate arrays (FPGAs), controllers, microcontrollers, processor cores, or other types of processing devices.

Generally, any of the functions described herein can be implemented using software, firmware, hardware (e.g., fixed-logic circuitry), or a combination of these implementations. The term "component" as used herein generally represents software, firmware, hardware, whole devices or networks, or a combination thereof. In the case of a software implementation, for instance, these may represent program code that performs specified tasks when executed on a processor (e.g., CPU or CPUs). The program code can be stored in one or more computer-readable memory devices, such as computer-readable storage media. The features and techniques of the component are platform-independent, meaning that they may be implemented on a variety of commercial computing platforms having a variety of processing configurations.

Example Methods

Detailed example implementations of simulation, encoding, and rendering concepts have been provided above. The example methods provided in this section are merely intended to summarize the present concepts.

Figure 14:
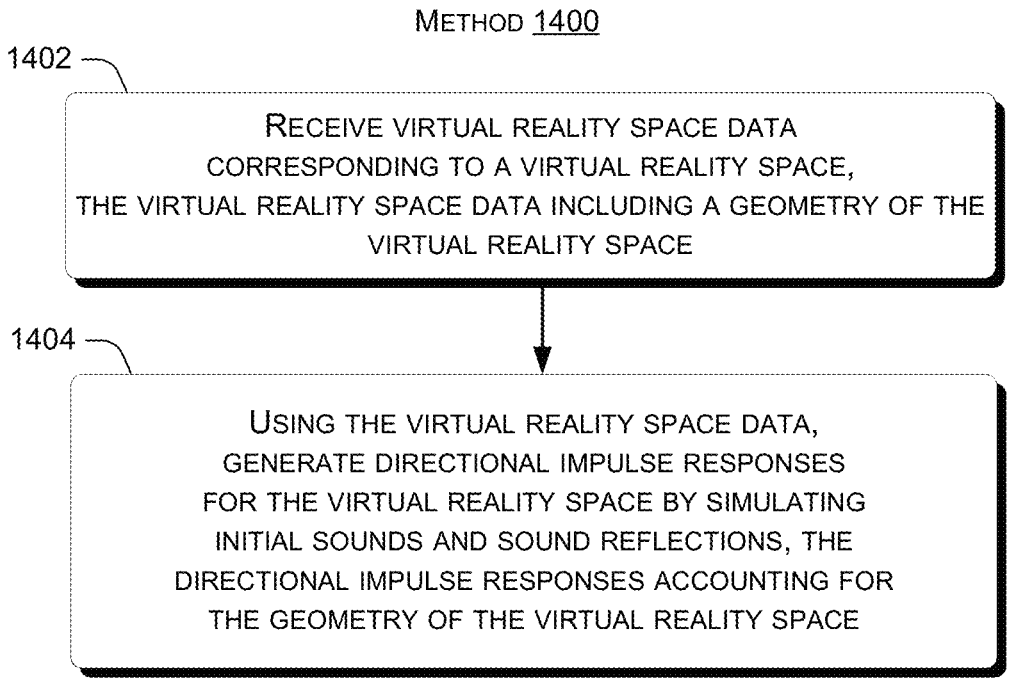
FIGS. 14-17 are flowcharts of example methods in accordance with some implementations of the present concepts.

As shown in FIG. 14, at block 1402, method 1400 can receive virtual reality space data corresponding to a virtual reality space. In some cases, the virtual reality space data can include a geometry of the virtual reality space. For instance, the virtual reality space data can describe structures, such as surface(s) and/or portal(s). The virtual reality space data can also include additional information related to the geometry, such as surface texture, material, thickness, etc.

At block 1404, method 1400 can use the virtual reality space data to generate directional impulse responses for the virtual reality space. In some cases, method 1400 can generate the directional impulse responses by simulating initial sounds emanating from multiple moving sound sources and/or arriving at multiple moving listeners. Method 1400 can also generate the directional impulse responses by simulating sound reflections in the virtual reality space. In some cases, the directional impulse responses can account for the geometry of the virtual reality space.

Figure 15:
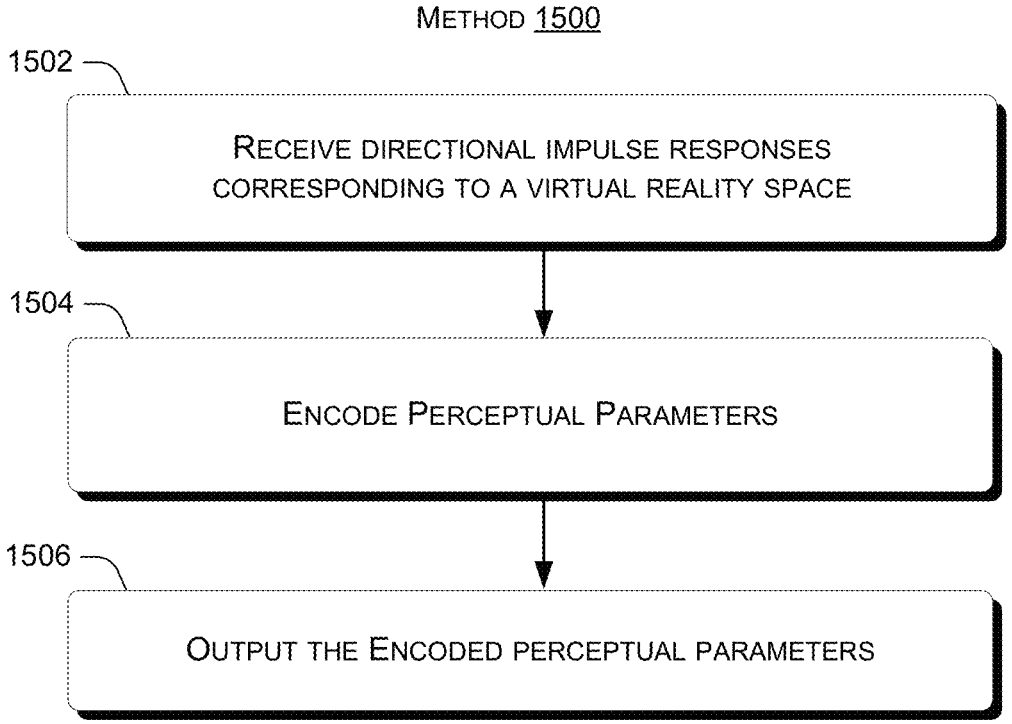

As shown in FIG. 15, at block 1502, method 1500 can receive directional impulse responses corresponding to a virtual reality space. The directional impulse responses can correspond to multiple sound source locations and/or multiple listener locations in the virtual reality space.

At block 1504, method 1500 can encode perceptual parameters derived from the directional impulse responses using parameterized encoding. The encoded perceptual parameters can include any of the perceptual parameters discussed herein.

At block 1506, method 1500 can output the encoded perceptual parameters. For instance, method 1500 can output the encoded perceptual parameters on storage. The encoded perceptual parameters can provide information such as initial sound departure directions and/or directional reflection energy for directional sound rendering.

Figure 16:
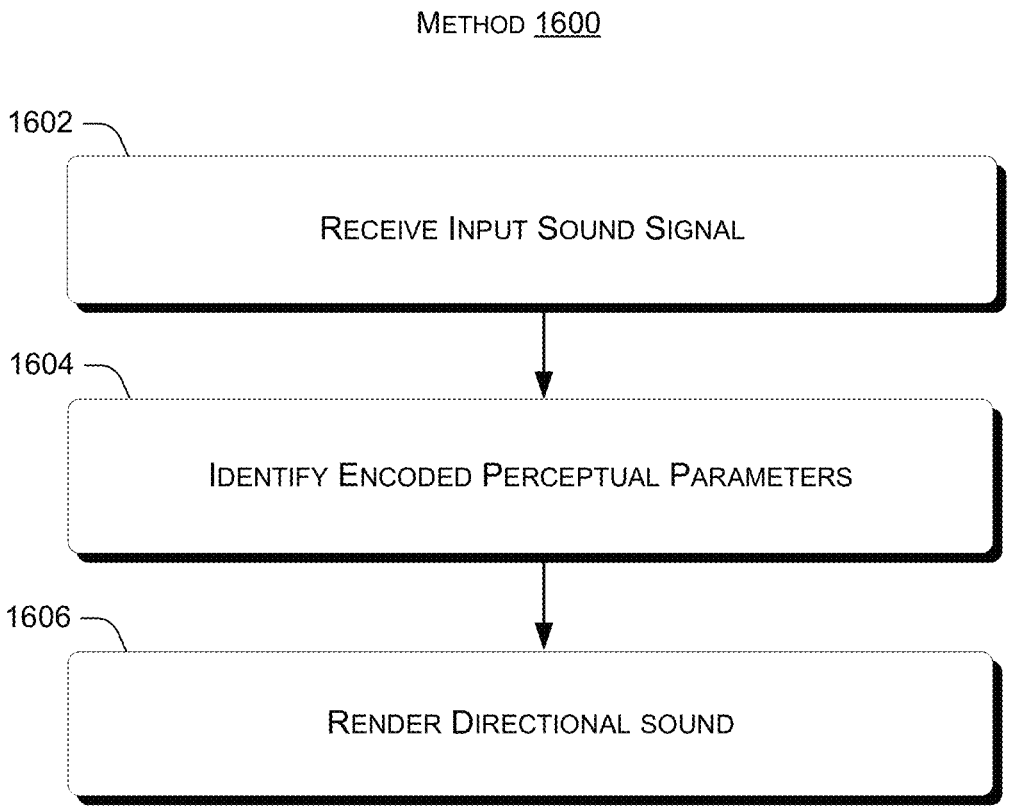

As shown in FIG. 16, at block 1602, method 1600 can receive an input sound signal for a directional sound source having a corresponding source location and source orientation in a scene At block 1604, method 1600 can identify encoded perceptual parameters corresponding to the source location.

At block 1606, method 1600 can use the input sound signal and the perceptual parameters to render an initial directional sound and/or directional sound reflections that account for the source location and source orientation of the directional sound source.

Figure 17:
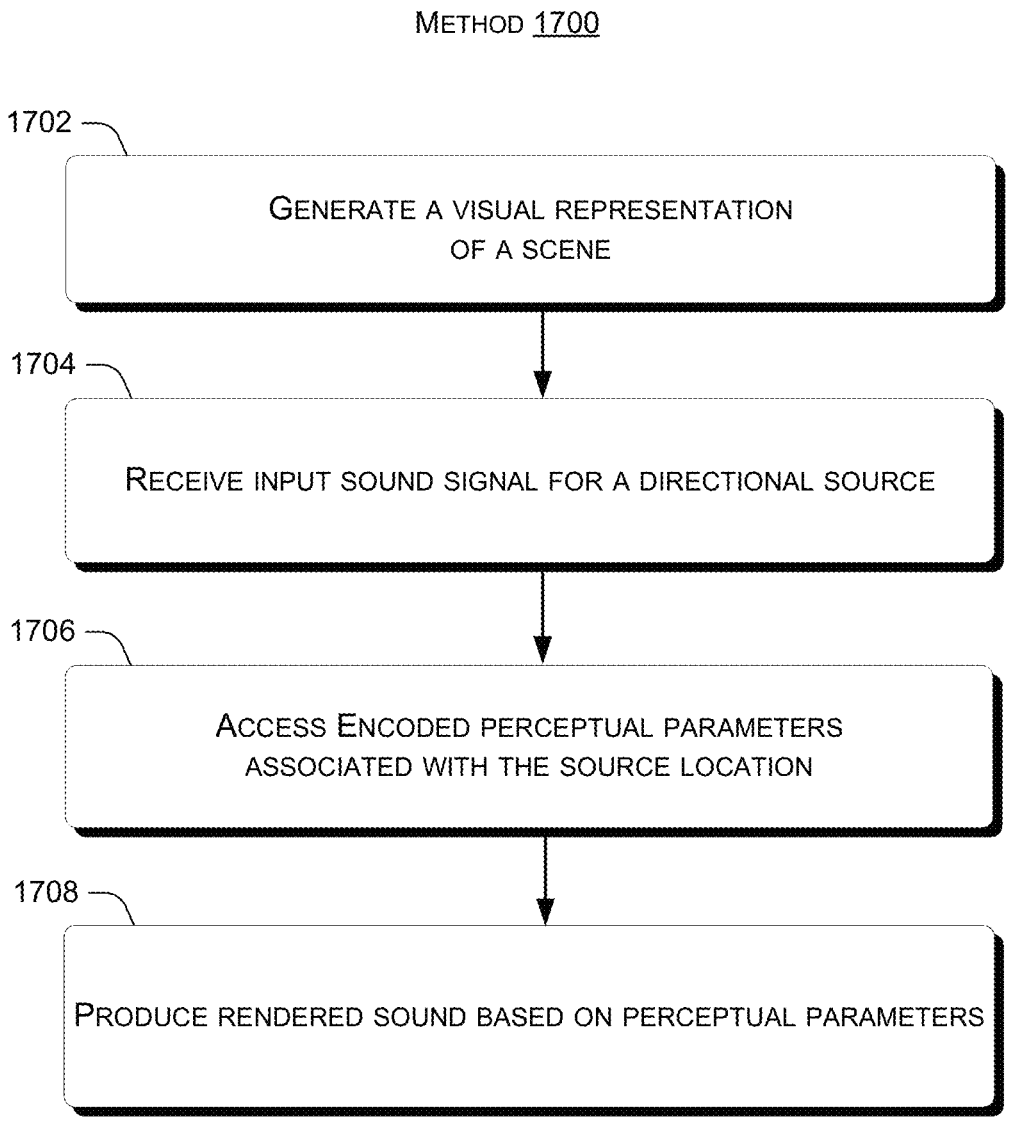

As shown in FIG. 17, at block 1702, method 1700 can generate a visual representation of a scene.

At block 1704, method 1700 can receive an input sound signal for a directional sound source having a corresponding source location and source orientation in the scene.

At block 1706, method 1700 can access encoded perceptual parameters associated with the source location.

At block 1708, method 1700 can produce rendered sound based at least in part on the perceptual parameters.

The described methods can be performed by the systems and/or devices described above, and/or by other devices and/or systems. The order in which the methods are described is not intended to be construed as a limitation, and any number of the described acts can be combined in any order to implement the methods, or an alternate method(s). Furthermore, the methods can be implemented in any suitable hardware, software, firmware, or combination thereof, such that a device can implement the methods. In one case, the method or methods are stored on computer-readable storage media as a set of instructions such that execution by a computing device causes the computing device to perform the method(s).

ADDITIONAL EXAMPLES

Various device examples are described above. Additional examples are described below. One example includes a system comprising a processor and storage storing computer-readable instructions which, when executed by the processor, cause the processor to: receive an input sound signal for a directional sound source having a source location and source orientation in a scene, identify an encoded departure direction parameter corresponding to the source location of the directional sound source in the scene, and based at least on the encoded departure direction parameter and the input sound signal, render a directional sound that accounts for the source location and source orientation of the directional sound source.

Another example can include any of the above and/or below examples where the computer-readable instructions which, when executed by the processor, cause the processor to receive a listener location of a listener in the scene and identify the encoded departure direction parameter from a precomputed departure direction field based at least on the source location and the listener location.

Another example can include any of the above and/or below examples where the directional sound comprises an initial sound, and the encoded departure direction represents a direction of initial sound travel from the source location to the listener location in the scene.

Another example can include any of the above and/or below examples where the computer-readable instructions which, when executed by the processor, cause the processor to obtain directivity characteristics of the directional sound source and an orientation of the directional sound source and render the initial sound accounting for the directivity characteristics and the orientation of the directional sound source.

Another example can include any of the above and/or below examples where the computer-readable instructions further cause the processor to obtain directional hearing characteristics of the listener and an orientation of the listener and render the initial sound as binaural output that accounts for the directional hearing characteristics and the orientation of the listener.

Another example can include any of the above and/or below examples where the directivity characteristics of the directional sound source comprise a source directivity function, and the directional hearing characteristics of the listener comprise a head-related transfer function.

Another example includes a system comprising a processor and storage storing computer-readable instructions which, when executed by the processor, cause the processor to: receive an input sound signal for a directional sound source having a source location and source orientation in a scene, identify encoded directional reflection parameters that are associated with the source location of the directional sound source, and based at least on the input sound signal and the encoded directional reflection parameters that are associated with the source location, render directional sound reflections that account for the source location and source orientation of the directional sound source.

Another example can include any of the above and/or below examples where the computer-readable instructions which, when executed by the processor, cause the processor to receive a listener location of a listener in the scene and identify the encoded directional reflection parameters based at least on the source location and the listener location.

Another example can include any of the above and/or below examples where the encoded directional reflection parameters comprise an aggregate representation of reflection energy departing in different directions from the source location and arriving from different directions at the listener location.

Another example can include any of the above and/or below examples where the computer-readable instructions which, when executed by the processor, cause the processor to: obtain directivity characteristics of the directional sound source, obtain directional hearing characteristics of the listener, and render the directional sound reflections accounting for the directivity characteristics of the directional sound source, the source orientation of the directional sound source, the directional hearing characteristics of the listener, and the listener orientation of the listener.

Another example can include any of the above and/or below examples where the aggregate representation of reflection energy comprises a reflections transfer matrix.

Another example can include any of the above and/or below examples where the system can be provided in a gaming console configured to execute video games or a virtual reality device configured to execute virtual reality applications.

Another example includes a method comprising receiving impulse responses corresponding to a scene, the impulse responses corresponding to multiple sound source locations and a listener location in the scene, encoding the impulse responses to obtain encoded departure direction parameters for individual sound source locations, and outputting the encoded departure direction parameters, the encoded departure direction parameters providing sound departure directions from the individual sound source locations for rendering of sound.

Another example can include any of the above and/or below examples where the encoded departure direction parameters convey respective directions of initial sound emitted from the individual sound source locations to the listener location.

Another example can include any of the above and/or below examples where the method further comprises encoding initial loudness parameters for the individual sound source locations and outputting the encoded initial loudness parameters with the encoded departure direction parameters.

Another example can include any of the above and/or below examples where the method further comprises determining the encoded departure direction parameters for initial sound during a first time period and determining the initial loudness parameters during a second time period that encompasses the first time period.

Another example can include any of the above and/or below examples where the method further comprises for the individual sound source locations, encoding respective aggregate representations of reflection energy for corresponding combinations of departure and arrival directions.

Another example can include any of the above and/or below examples where the method further comprises decomposing reflections in the impulse responses into directional loudness components and aggregating the directional loudness components to obtain the aggregate representations.

Another example can include any of the above and/or below examples where a particular aggregate representation for a particular source location includes at least: aggregate loudness of reflections arriving at the listener location from a first direction and departing from the particular source location in the first direction, a second direction, a third direction, and a fourth direction, aggregate loudness of reflections arriving at the listener location from the second direction and departing from the particular source location in the first direction, the second direction, the third direction, and the fourth direction, aggregate loudness of reflections arriving at the listener location from the third direction and departing from the particular source location in the first direction, the second direction, the third direction, and the fourth direction, and aggregate loudness of reflections arriving at the listener location from the fourth direction and departing from the particular source location in the first direction, the second direction, the third direction, and the fourth direction.

Another example can include any of the above and/or below examples where the particular aggregate representation comprises a reflections transfer matrix.

CONCLUSION

The description relates to parameterize encoding and rendering of sound. The disclosed techniques and components can be used to create accurate and immersive sound renderings for video game and/or virtual reality experiences. The sound renderings can include higher fidelity, more realistic sound than available through other sound modeling and/or rendering methods. Furthermore, the sound renderings can be produced within reasonable processing and/or storage budgets.

Although techniques, methods, devices, systems, etc., are described in language specific to structural features and/or methodological acts, it is to be understood that the subject matter defined in the appended claims is not necessarily limited to the specific features or acts described. Rather, the specific features and acts are disclosed as exemplary forms of implementing the claimed methods, devices, systems, etc.

The invention claimed is:

1. A system, comprising:

a processor; and storage storing computer-readable instructions which, when executed by the processor, cause the system to:

receive an input sound signal for a directional sound source having a source location and a source orientation in a scene;

identify an encoded departure direction parameter corresponding to the source location of the directional sound source in the scene, the encoded departure direction parameter specifying a departure direction of initial sound on a sound path in which sound travels from the source location to a listener location around an occlusion in the scene; and based at least on the encoded departure direction parameter and the input sound signal, render a directional sound at the listener location in a manner that accounts for the source location and the source orientation of the directional sound source.

2. The system of claim 1, wherein the computer-readable instructions, when executed by the processor, cause the system to:

identify the encoded departure direction parameter from a precomputed departure direction field based at least on the source location and the listener location.

3. The system of claim 2, wherein the computer-readable instructions, when executed by the processor, cause the system to:

compute the departure direction field from a representation of the scene.

4. The system of claim 2, wherein the computer-readable instructions, when executed by the processor, cause the system to:

obtain directivity characteristics of the directional sound source; and render the initial sound accounting for the directivity characteristics and the source orientation of the directional sound source.

5. The system of claim 4, wherein the computer-readable instructions, when executed by the processor, cause the system to:

obtain directional hearing characteristics of a listener at the listener location and a listener orientation of the listener; and render the initial sound as binaural output that accounts for the directional hearing characteristics of the listener and the listener orientation.

6. The system of claim 5, wherein the directivity characteristics of the directional sound source comprise a source directivity function, and the directional hearing characteristics of the listener comprise a head-related transfer function.

7. A system, comprising:

a processor; and storage storing computer-readable instructions which, when executed by the processor, cause the system to:

receive an input sound signal for a directional sound source having a source location and a source orientation in a scene;

identify encoded directional reflection parameters that are associated with the source location of the directional sound source and a listener location, wherein the encoded directional reflection parameters comprise aggregate directional loudness components of reflection energy from corresponding combinations of departure and arrival directions, and the aggregate directional loudness components are aggregated from decomposed directional loudness components of reflections emitted from the source location and arriving at the listener location; and based at least on the input sound signal and the encoded directional reflection parameters, render directional sound reflections at the listener location that account for the source location and the source orientation of the directional sound source.

8. The system of claim 7, wherein the computer-readable instructions, when executed by the processor, cause the system to:

encode the directional reflection parameters for the source location and the listener location prior to receiving the input sound signal.

9. The system of claim 8, wherein the computer-readable instructions, when executed by the processor, cause the system to:

perform reflection simulations in the scene and decompose reflection loudness values obtained during the reflection simulations to obtain the aggregate directional loudness components.

10. The system of claim 7, wherein the computer-readable instructions, when executed by the processor, cause the system to:

obtain directivity characteristics of the directional sound source;

obtain directional hearing characteristics of a listener at the listener location; and render the directional sound reflections accounting for the directivity characteristics of the directional sound source, the source orientation of the directional sound source, the directional hearing characteristics of the listener, and a listener orientation of the listener.

11. The system of claim 10, wherein the encoded directional reflection parameters comprise a reflections transfer matrix associated with the source location and the listener location.

12. The system of claim 7, provided in a gaming console configured to execute video games or a virtual reality device configured to execute virtual reality applications.

13. A method comprising:

receiving impulse responses corresponding to a scene, the impulse responses corresponding to multiple sound source locations and a listener location in the scene;

encoding the impulse responses to obtain encoded departure direction parameters for individual sound source locations and the listener location, the encoded departure direction parameters providing sound departure directions from the individual sound source locations to the listener location;

encoding the impulse responses to obtain encoded aggregate representations of reflection enemy for corresponding combinations of departure and arrival directions of reflections traveling from the individual sound source locations to the listener location, the encoded aggregate representations of reflection energy being obtained by decomposing reflections in the impulse responses into directional loudness components and aggregating the directional loudness components; and outputting the encoded departure direction parameters and the encoded aggregate representations of reflection energy.

14. The method of claim 13, wherein the encoded departure direction parameters convey respective directions of initial sound emitted from the individual sound source locations to the listener location.

15. The method of claim 13, further comprising:

encoding initial loudness parameters for the individual sound source locations; and outputting the encoded initial loudness parameters with the encoded departure direction parameters.

16. The method of claim 15, further comprising:

determining the encoded departure direction parameters for initial sound during a first time period; and determining the initial loudness parameters during a second time period that encompasses the first time period.

17. The method of claim 13, wherein a particular encoded aggregate representation for a particular source location includes at least:

aggregate loudness of reflections arriving at the listener location from a first direction and departing from the particular source location in the first direction, a second direction, a third direction, and a fourth direction;

aggregate loudness of reflections arriving at the listener location from the second direction and departing from the particular source location in the first direction, the second direction, the third direction, and the fourth direction;

aggregate loudness of reflections arriving at the listener location from the third direction and departing from the particular source location in the first direction, the second direction, the third direction, and the fourth direction; and aggregate loudness of reflections arriving at the listener location from the fourth direction and departing from the particular source location in the first direction, the second direction, the third direction, and the fourth direction.

18. The method of claim 17, wherein the particular encoded aggregate representation comprises a reflections transfer matrix.

19. The method of claim 18, further comprising:

generating and outputting multiple reflections transfer matrices for multiple source/listener location pairs in the scene.

20. The method of claim 13, further comprising:

rendering sound emitted from a particular directional sound source at a particular source location to a listener at a particular listener location based at least on a particular encoded departure direction parameter, a particular encoded arrival direction parameter, and a particular encoded aggregate representation of reflection energy for the particular source location and the particular listener location.

* * * * *